US011805877B2

(12) United States Patent
Majhess et al.

(10) Patent No.: US 11,805,877 B2
(45) Date of Patent: Nov. 7, 2023

(54) TRAVEL BAGS HAVING A PORTABLE AND INTEGRATED AND REUSABLE VACUUM COMPRESSION SYSTEM WITH RECHARGEABLE REMOVABLE BATTERY

(71) Applicant: OBSIDIAN LUGGAGE TECHNOLOGIES INTERNATIONAL, INC., San Juan, PR (US)

(72) Inventors: Joseph M. Majhess, Boca Raton, FL (US); Mark A. Jacobs, San Juan, OR (US); Craig Benson, Melbourne Beach, FL (US); Kevin Ellsworth, Lebelle, FL (US); Salvador Herrera, Tamarac, FL (US)

(73) Assignee: OBSIDIAN LUGGAGE TECHNOLOGIES INTERNATIONAL, INC., San Juan, PR (US)

( * ) Notice: Subject to any disclaimer, the term of this patent is extended or adjusted under 35 U.S.C. 154(b) by 0 days.

(21) Appl. No.: 17/363,952

(22) Filed: Jun. 30, 2021

(65) Prior Publication Data

US 2021/0321732 A1 Oct. 21, 2021

Related U.S. Application Data

(63) Continuation-in-part of application No. 16/538,773, filed on Aug. 12, 2019, now Pat. No. 11,484,105, (Continued)

(51) Int. Cl.

| | |
|---|---|
| ***A45C 13/02*** | (2006.01) |
| ***A45C 15/00*** | (2006.01) |
| ***A45C 11/00*** | (2006.01) |

(52) U.S. Cl.
CPC ..... *A45C 13/02* (2013.01); *A45C 15/00* (2013.01); *A45C 2011/002* (2013.01); *A45C 2013/028* (2013.01)

(58) Field of Classification Search
CPC ... A45C 13/02; A45C 15/00; A45C 2011/002; A45C 2013/028
See application file for complete search history.

(56) References Cited

U.S. PATENT DOCUMENTS 5,005,470 A * 4/1991 Denker ..... B08B 15/026 15/301
6,135,253 A * 10/2000 Weissman ..... A45C 13/02 190/110

(Continued)

*Primary Examiner* — Tri M Mai
(74) *Attorney, Agent, or Firm* — DANIEL S. POLLEY, P.A.

(57) ABSTRACT

Various types of travel bags are provided with at least one portable self-contained vacuum compression system having a portable vacuum pump powered by a portable, preferably removable, rechargeable battery, a compression connection system, and a vacuum compression bag secured within the interior space of the travel bag. The portable self-contained vacuum compression system allows the user to pack more clothing or compressible goods into their travel bag via the use of vacuum compression. The air inside the compression bag can be evacuated by the attached self-contained vacuum pump assembly which is secured within the travel bag in a manner to hold the self-contained vacuum system within the travel bag's internal dimensions in one embodiment. The vacuum compression system can be held in place via a removable or a fixed frame that permits operation of the vacuum compression system within the internal dimensions of the travel bag. The vacuum pump can exhaust vented air either to the atmosphere within the travel bag or via an exhaust vent built into the travel bag. The compression bag can be attached to the vacuum system via a compression connection system or fastener having a back flow check (Continued)

valve which permits the one way flow of air from the compression bag into the vacuum pump system and also provides a seating and sealing function of the compression bag connected with the vacuum pump to maintain the air tightness between the vacuum compression bag and the vacuum pump system. The clothing or other compressed goods can remain in their compressed state within the travel bag until such time that the user opens the compression bag which will release the vacuum seal and permits the user to access the contents of the vacuum compression bag. The fully portable and reusable characteristics of the self-contained vacuum compression system will permit the user to remove some or all of the travel bag contents and to recompress the remaining or replaced travel bag contents.

15 Claims, 35 Drawing Sheets

Related U.S. Application Data which is a continuation-in-part of application No. 16/272,272, filed on Feb. 11, 2019, now Pat. No. 10,376,031.

(60) Provisional application No. 63/048,100, filed on Jul. 4, 2020.

(56) References Cited

U.S. PATENT DOCUMENTS

| | | | | |
|---|---|---|---|---|
| 6,135,277 | A * | 10/2000 | Armstrong | A45C 13/02 206/314 |
| 6,202,849 | B1 * | 3/2001 | Graham | B65D 25/16 206/524.8 |
| 6,393,656 | B1 * | 5/2002 | Paterson | A47L 5/36 15/327.5 |
| 6,971,417 | B2 * | 12/2005 | Deni | B65B 31/047 141/114 |
| 7,603,875 | B2 * | 10/2009 | Carr | F24F 5/0017 62/457.7 |
| 8,459,422 | B1 * | 6/2013 | Efron | A45C 13/02 190/109 |
| 9,385,549 | B2 * | 7/2016 | Miller | H02J 7/00032 |
| 9,668,559 | B1 * | 6/2017 | Moyal | A45C 13/02 |
| 9,966,771 | B2 * | 5/2018 | Cross | H02J 7/0013 |
| 10,376,031 | B1 * | 8/2019 | Majhess | A45C 5/03 |
| 10,609,996 | B2 * | 4/2020 | Gregory | A45F 3/04 |
| 2009/0145939 | A1 * | 6/2009 | Robinson | A45F 3/04 224/231 |
| 2011/0259693 | A1 * | 10/2011 | Nascarella | A45C 7/0022 190/18 A |
| 2013/0043826 | A1 * | 2/2013 | Workman | H01M 50/20 320/101 |
| 2013/0048456 | A1 * | 2/2013 | Govor | A45C 13/02 190/111 |
| 2013/0228490 | A1 * | 9/2013 | Park | B65D 81/203 206/524.8 |
| 2019/0069659 | A1 * | 3/2019 | Van Loon | A45C 9/00 |

* cited by examiner

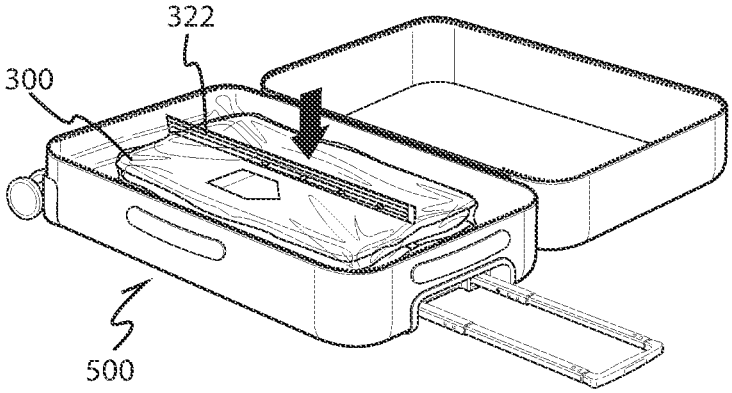
Fig-2-D

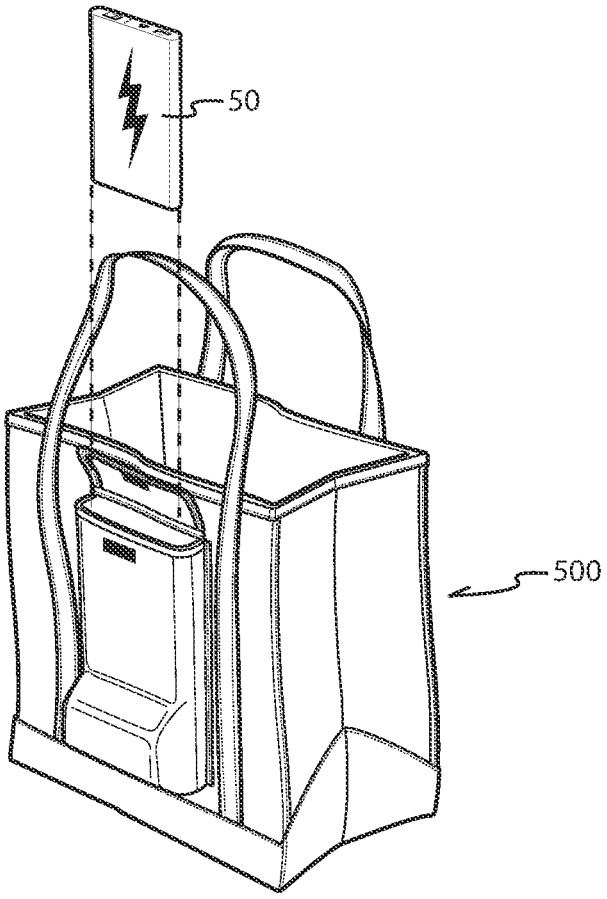
Figure-6-A

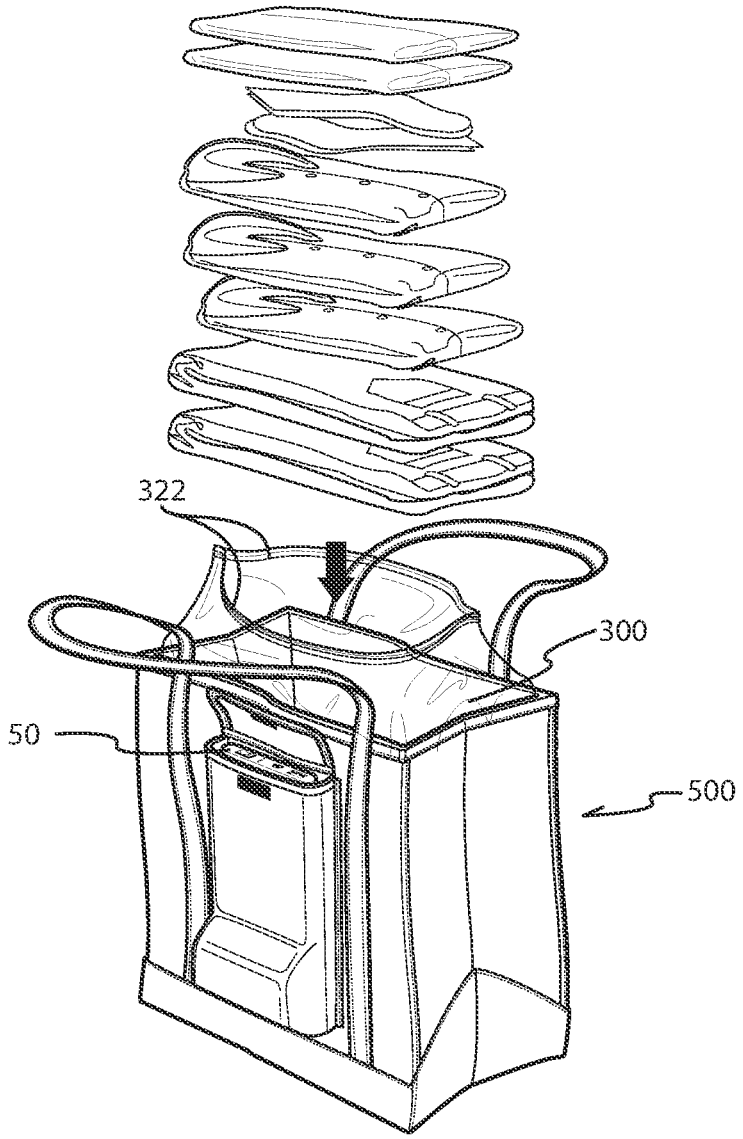
Figure-6-B

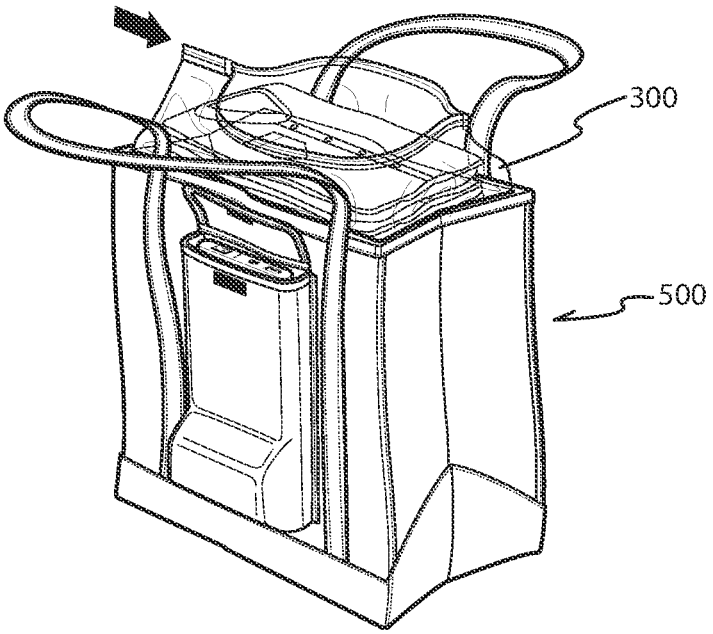
Figure-6-C

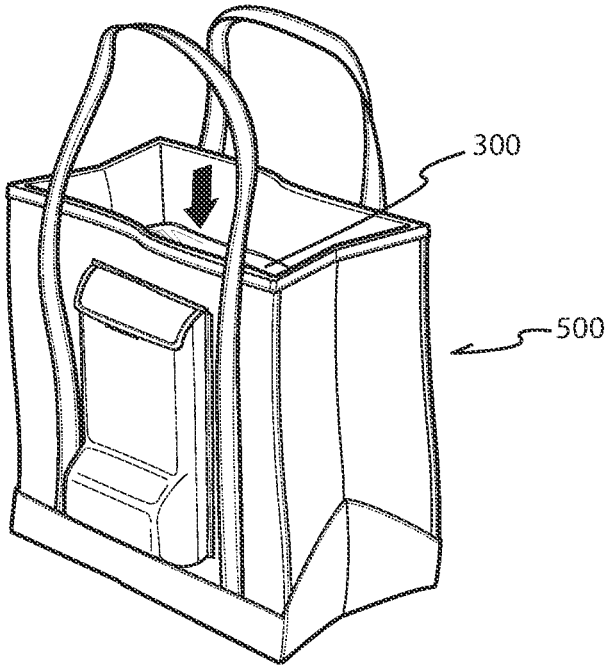
Figure-6-D

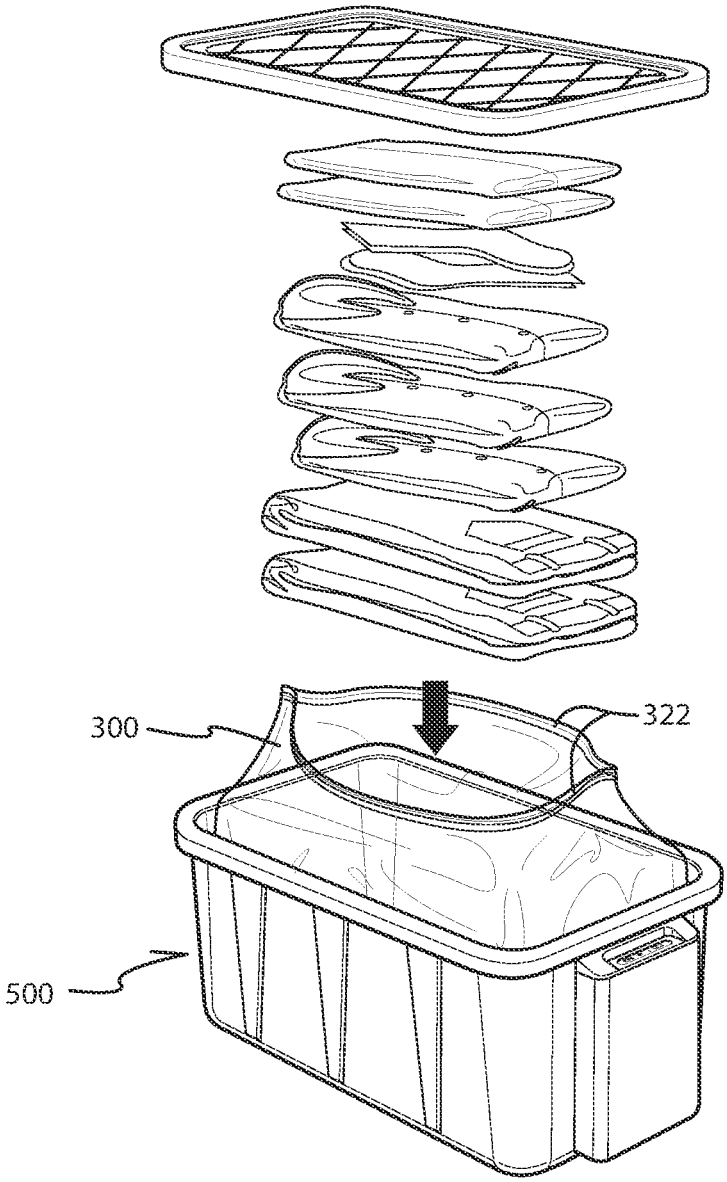
Fig-7-B

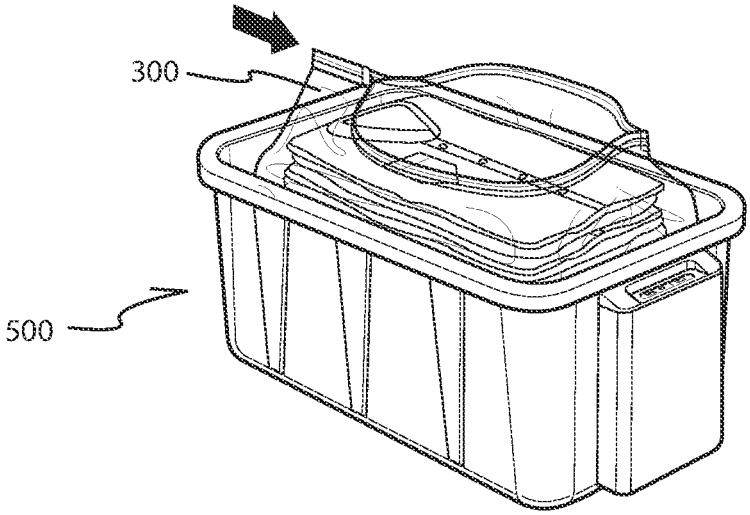
Fig-7-C

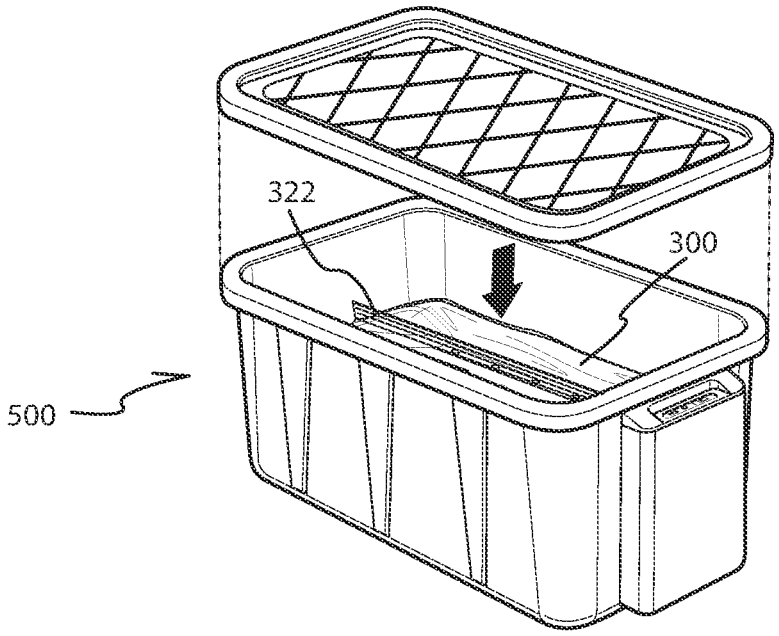
Fig-7-D

TRAVEL BAGS HAVING A PORTABLE AND INTEGRATED AND REUSABLE VACUUM COMPRESSION SYSTEM WITH RECHARGEABLE REMOVABLE BATTERY

This application is a continuation-in-part of U.S. application Ser. No. 16/538,773, filed Aug. 12, 2019, which is a continuation-in-part of U.S. application Ser. No. 16/272,272, filed Feb. 11, 2019, now U.S. Pat. No. 10,376,031 and this application also claims the benefit of and priority to U.S. Application Ser. No. 63/048,100, filed Jul. 4, 2020, all of the above applications are incorporated by reference in their entireties as if fully set forth herein and for all purposes.

FIELD OF THE DISCLOSURE

The disclosure relates generally to travel bags of all descriptions and more particularly to a novel travel bag having a portable integrated vacuum compression system with rechargeable battery which may be removable.

BACKGROUND

For centuries travelers have used a variety of cases, steamer trunks, chests, wardrobes, and suitcases to transport clothing and goods on their travels. In the last century new products and techniques have been refined to the point where the modern traveler has hundreds of styles of suitcases, luggage, duffle bags, travel bags, backpacks, or other similar portable containers (collectively "travel containers").

Recently the use and advantages of a separate external clothing compression bag for reducing the space required for the clothing in one of the above-mentioned travel containers has been introduced. Separately and externally compressed bags of clothing permits more clothing to be packed in the same internal space of the travel container as compared to the amount of clothing that will fit in such space using manual packing techniques. Any travel container incorporating these external clothing compression bags packing techniques suffer from one or more problems, including but not limited to: 1) the limitation of one time use when there is no vacuum available for use of the compression bag on the subsequent legs or return leg of the trip, 2) the fact that once the vacuum of the separate compression bag is released when the bag is opened and unpacked the vacuum compression space saving features are no longer obtainable, 3) the sorrow of not having enough space to bring home the clothing or accessories acquired on the trip, 4) the impracticality of carrying vacuums not designed to be light or small or self-contained which defeat the purpose of weight and space limitations, and 5) the added costs of added luggage fees from the purchase of additional luggage on the return trip home.

The novel devices described herein address one or more of the above-described problems.

SUMMARY OF THE DISCLOSURE

Generally, novel device embodiments described below and shown in the accompanying drawings are designed to improve and extend the functional capacity of a travel container or travel bag (as defined below) by providing the ability to carry more clothing or objects in the travel bag via a self-contained, convenient and efficient internal, portable and reusable integrated vacuum compression system.

The disclosed travel container or travel bag generally can be provided with a novel portable integrated compression system, preferably comprising: 1) a vacuum motor with an intake port for suction and evacuation of air from the compression bag and an exhaust port for expelled air (hereafter "vacuum") which can be preferably powered by a rechargeable battery (hereafter "battery") which may be removed from the travel bag, such as when transporting the travel bag, 2) a reusable vacuum compression bag (hereafter "compression bag") which is used to hold packed clothing or other goods, to vacuum compress, and to transport the compressed clothing or goods within the travel bag, and 3) one or more connecting interface systems preferably utilizing one or more back check valves and one or more air tight connections between the vacuum and the compression bag which holds the compression bag in a fixed and airtight manner while connected to the vacuum intake port and which can also be removed or disconnected or detached at the time the compression bag is to be replaced (the entire interface system connection being referred to hereafter as the "compression connection system".) These preferred three major components are referred to collectively as the "vacuum compression system." Each of these novel components are further described below.

Travel bags of all types (including without limitation hard shell and soft shell travel bag of all sizes, luggage of all sizes, suitcases of all sizes, duffle bags of all sizes, travel bags of all sizes, backpacks of all sizes, travel containers of all sizes, tote or carry bags of all sizes, garment bags and foldable garment bags of all sizes and other portable hard shell or soft shell containers of all sizes (collectively hereafter: "travel bag" or "travel bags") are preferably provided with at least one "portable self-contained vacuum compression system" comprising 1) the above-referenced portable vacuum pump powered by a portable rechargeable battery, 2) a compression connection system, and 3) a preferably custom sized vacuum compression bag secured within the interior space of the travel bag. The portable self-contained vacuum compression system allows the user to pack more clothing or compressible goods into their travel bag via vacuum compression. The air inside the compression bag can be evacuated by an attached self-contained vacuum pump assembly which is secured within the travel bag in a manner to hold the self-contained vacuum system within the travel bag's internal dimensions. At least one vacuum compression system can be held in place via a removable or a fixed frame that preferably permits operation of the vacuum compression system within the internal dimensions of the travel bag. The vacuum pump can exhaust vented air either to the atmosphere within the travel bag or via an exhaust vent built into the travel bag. The compression bag can be preferably attached to the vacuum system by a compression connection system or fastener preferably provided with one or more back flow check valves that can control the one way flow of air from the compression bag into the vacuum pump system.

The compression connection system can also provide a seating and sealing function of the compression bag connected with the vacuum pump which can maintain the air tightness between the vacuum compression bag and the vacuum pump system. Preferably, any compression bag can be removable from the vacuum pump system and the travel bag for replacement at such time that the compression bag needs replacement. The described novel self-contained vacuum system allows the use of an oversized compression bag as compared to the size of the travel bag. The clothing or other compressed goods can remain in their compressed state within the closed or partially closed travel bag until such time that the user opens the compression bag which releases the vacuum seal and permits the user to access the contents of the vacuum compression bag. The rechargeable battery for powering the vacuum assembly can be removable while the travel bag is partially or fully closed and can also be used to charge other electronic devices. The fully portable and reusable characteristics of the self-contained vacuum compression system will permit the user to remove some or all of the travel bag contents and to recompress the remaining or replaced travel bag contents.

BRIEF DESCRIPTION OF THE DRAWINGS

FIG. 2D is a perspective view of the vacuum bag and packed clothing having a reduced size and fitting within the dimensions of the luggage after use of the internal compression system in accordance with the present disclosure;

FIG. 6A is a perspective view of a representative sample for a carry bag/tote bag and having a self-contained internal, external or modular compression system which can be preferably mounted or disposed externally or internally at the bottom of the carry bag or within an outer compartment for the carry bag/tote bag in accordance with one embodiment of the present disclosure;

FIG. 6B is a perspective view of the carry bag/tote bag of FIG. 6A in an opened position and showing a vacuum bag opened and about to receive a plurality of clothing;

FIG. 6C is a perspective view of the clothing received and packed within the vacuum bag of FIG. 6B and protruding outward of the opened carry bag/tote bag prior to compression using the novel internal, external or modular compression system;

FIG. 6D is a perspective view of the vacuum bag and packed clothing having a reduced size and fitting within the dimensions of the carry bag/tote bag after use of the internal, external or modular compression system in accordance with the present disclosure;

FIG. 7B is a perspective view of the container of FIG. 7A in an opened position and showing a vacuum bag opened and about to receive a plurality of clothing;

FIG. 7C is a perspective view of the clothing received and packed within the vacuum bag of FIG. 7B and protruding outward of the opened container prior to compression using the novel internal, external or modular compression system;

FIG. 7D is a perspective view of the vacuum bag and packed clothing having a reduced size and fitting within the dimensions of the container after use of the internal, external or modular compression system in accordance with the present disclosure;

DETAILED DESCRIPTION

Figure 1A:
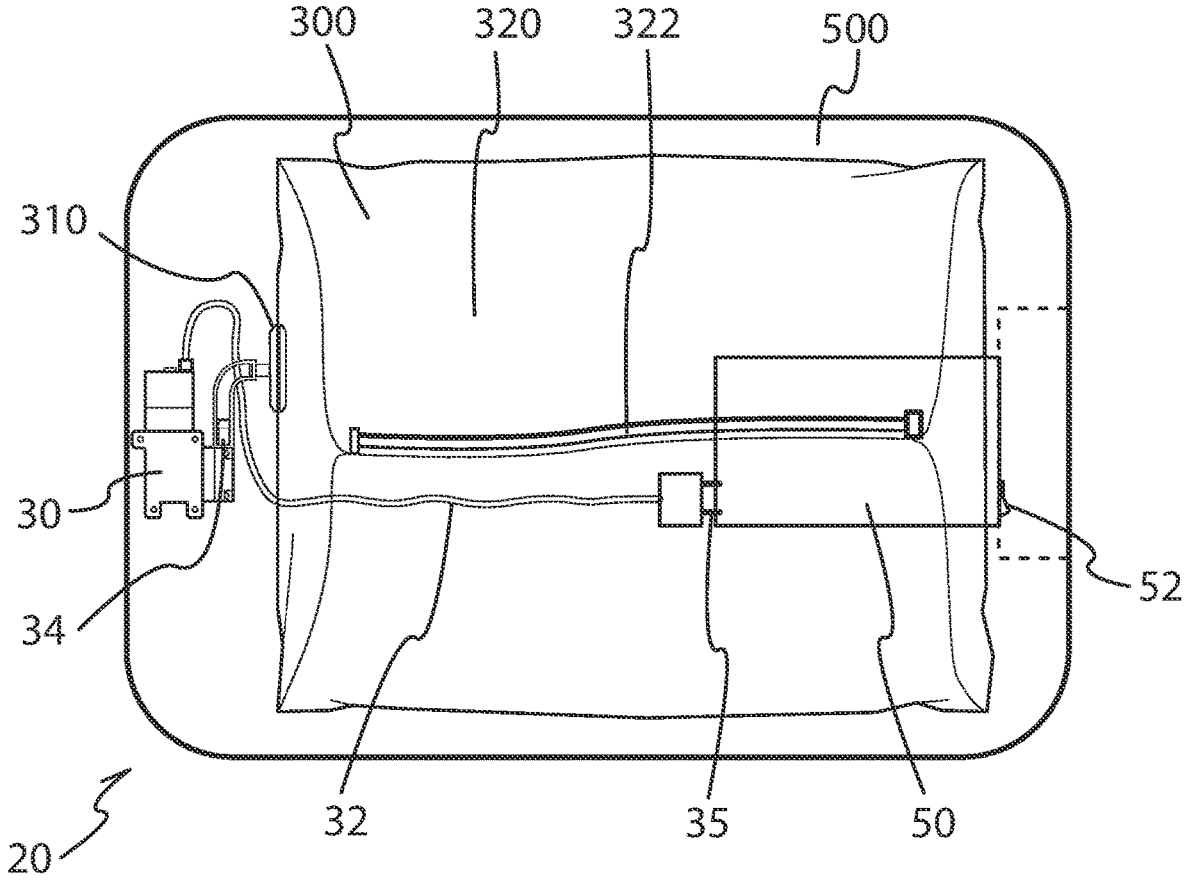
FIG. 1A illustrates a non-limiting embodiment of at least the main components for a self-contained portable vacuum compression system shown in a non-limiting internally integrated configuration in accordance with the present disclosure.

As seen in FIG. 1A a first non-limiting embodiment for an internally integrated self-contained vacuum compression system is disclosed which is generally designated as vacuum compression system 20. System 20 is shown internally integrated within a first non-limiting travel bag embodiment generally designated as first travel bag 500, which, without limitation, can have a hard, semi soft or soft outer structure of any size or shape.

System 20 preferably comprises a vacuum pump 30 and rechargeable battery 50. Preferably, vacuum pump 30 and removable rechargeable battery 50 are both removable from within first travel bag 500 after use to compress a compression bag 300. Power for operating vacuum pump 30 (i.e. power to pump) can be provided by a wire/power cord 32 which is preferably plugged into removable rechargeable battery 50. Though not preferred, it is also within the scope of the disclosure that the power cord can be plugged into a conventional outlet for powering vacuum pump 30 or that power to pump 30 can be provided by battery(ies) or rechargeable battery(ies). Vacuum pump can be provided with an intake port 34 and exhaust port which receives the air withdrawn from a vacuum bag 300. A connection tube, pipe, conduit, etc. (collectively "connection conduit 36") can be provided and is connected at one end to the intake port 34 and at a second end to a vacuum bag valve 310 (preferably one-way valve) to provided communication between vacuum bag valve 310 and intake port 34 such that when vacuum pump 30 is "on" air is withdrawn from within vacuum bag 300 causing bag 300 to compress and reduce in size. As vacuum bag valve 310 is preferably a one-way valve, when connection conduit 36 is removed from connection to valve 310, air is prevented from reentering vacuum bag 300 through valve 310. Vacuum bag 300 can be made or virtually made air-tight in use. A front access area 320 which can be achieved through a top zip lock configuration 322 (or other sealing mechanism) can be provided for packing clothes and other items withing compression bag 300. Vacuum bag 300 can be removable and replaceable with respect to travel bag 500.

Rechargeable battery 50 can be provided with an outlet/port/USB port, etc. for plugging or otherwise electronically connecting cord 32 to rechargeable battery 50 for powering vacuum pump 30. Thus, though a two prong wire is shown in FIG. 1A, other electrical connections can also be used for the end of cord 32 (i.e. three prong, one or more prong(s) 35 connection, one or more pin(s) connections, USB connector, etc.) Rechargeable battery 50 can also contain one or more other outlets/ports/USB ports for powering and charging other electronic devices, such as, without limitation, the user's cellphone, smart phone, electronic tablet, portable electric shaver, portable electric toothbrush, etc. as well as for use in recharging rechargeable battery 50 when it becomes low on power. Rechargeable battery can also be provided with a switch 52 which is used to control the operation ("off" and "on") of vacuum pump 30 when cord 32 is electrically connected to battery 50. When switch 52 in an "off" position, power/energy is prevented from being transferred to vacuum pump 30 so that it remains off. When switch 52 is in an "on" position, energy can flow to vacuum pump 30 to cause it to operate.

Figure 1B:
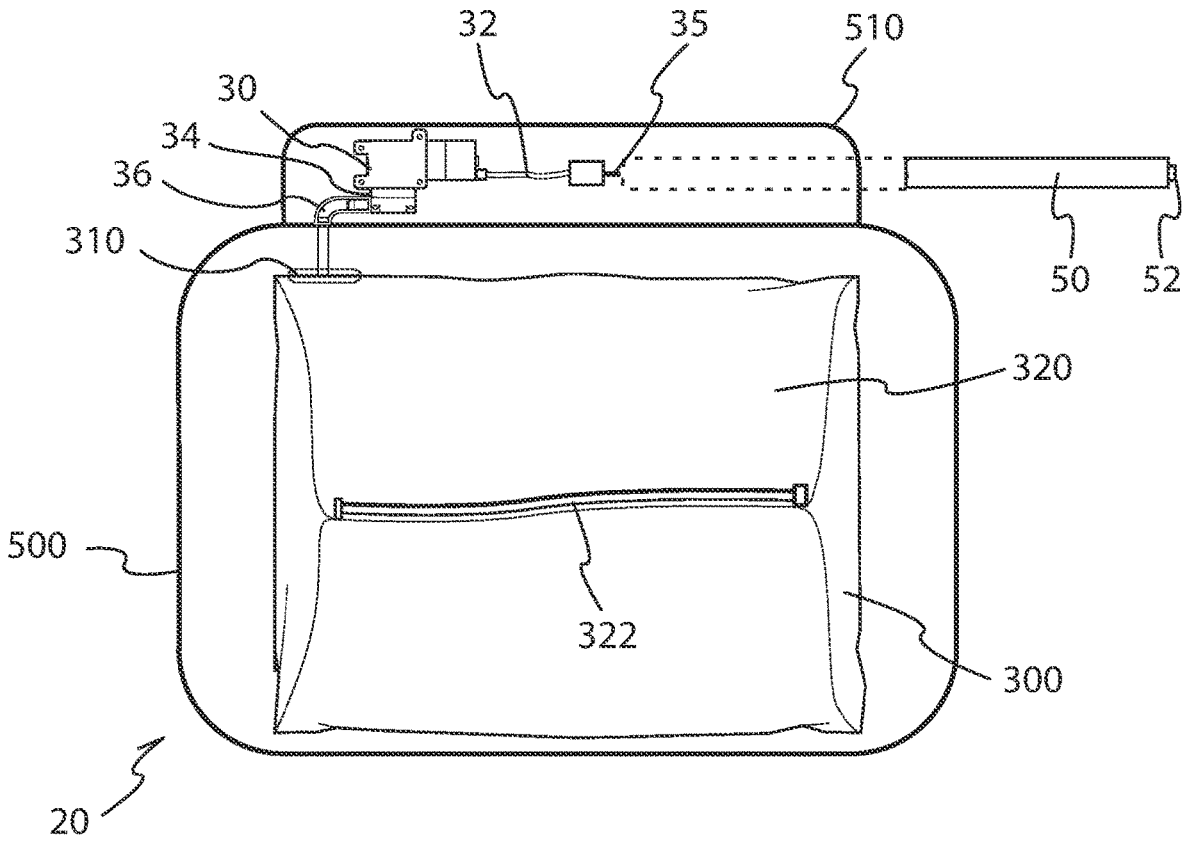
FIG. 1B illustrates a non-limiting embodiment of at least the main components for a self-contained portable vacuum compression system shown in a non-limiting external configuration in accordance with the present disclosure.

FIG. 1B illustrates the vacuum compression system 20 in a non-limiting external embodiment with respect to travel bag 500. In this embodiment, travel bag 500 is preferably provided with an outer/external compartment 510 for storing/housing and operating vacuum compression system 20. As seen, preferably both vacuum pump 30 and rechargeable battery 50 can be stored within compartment 510. It is within the scope of the disclosure, that vacuum pump 30 and rechargeable battery can still both be removable after use. However, it is also within the scope of the disclosure, that the vacuum pump 30 preferably remains stored/housed within compartment 510 (whether or not permanently stored within compartment 510) and only rechargeable battery is preferably removable from compartment during travels with travel bag 500. Vacuum pump 30 electrically connects to rechargeable battery 50 and the operation of vacuum pump 30 is controlled by switch 52 of rechargeable battery 50 similar to as described for FIG. 1A, which is incorporated by reference in its entirety. Preferably, an opening or pass-through is provided in the adjacent wall/side of travel bag 500 that borders both the main internal/storage area of travel bag 500 and the internal/storage area within compartment 510 to allow either a portion of one-way vacuum bag valve 310 (i.e. stem/tube portion 311) or a portion of connection conduit 36 to pass through in order to connect vacuum pump 30 with compression bag 300. The operation of vacuum compression system 20 remains the same as described for the embodiment of FIG. 1A which is incorporated by reference in its entirety.

Figure 1C:
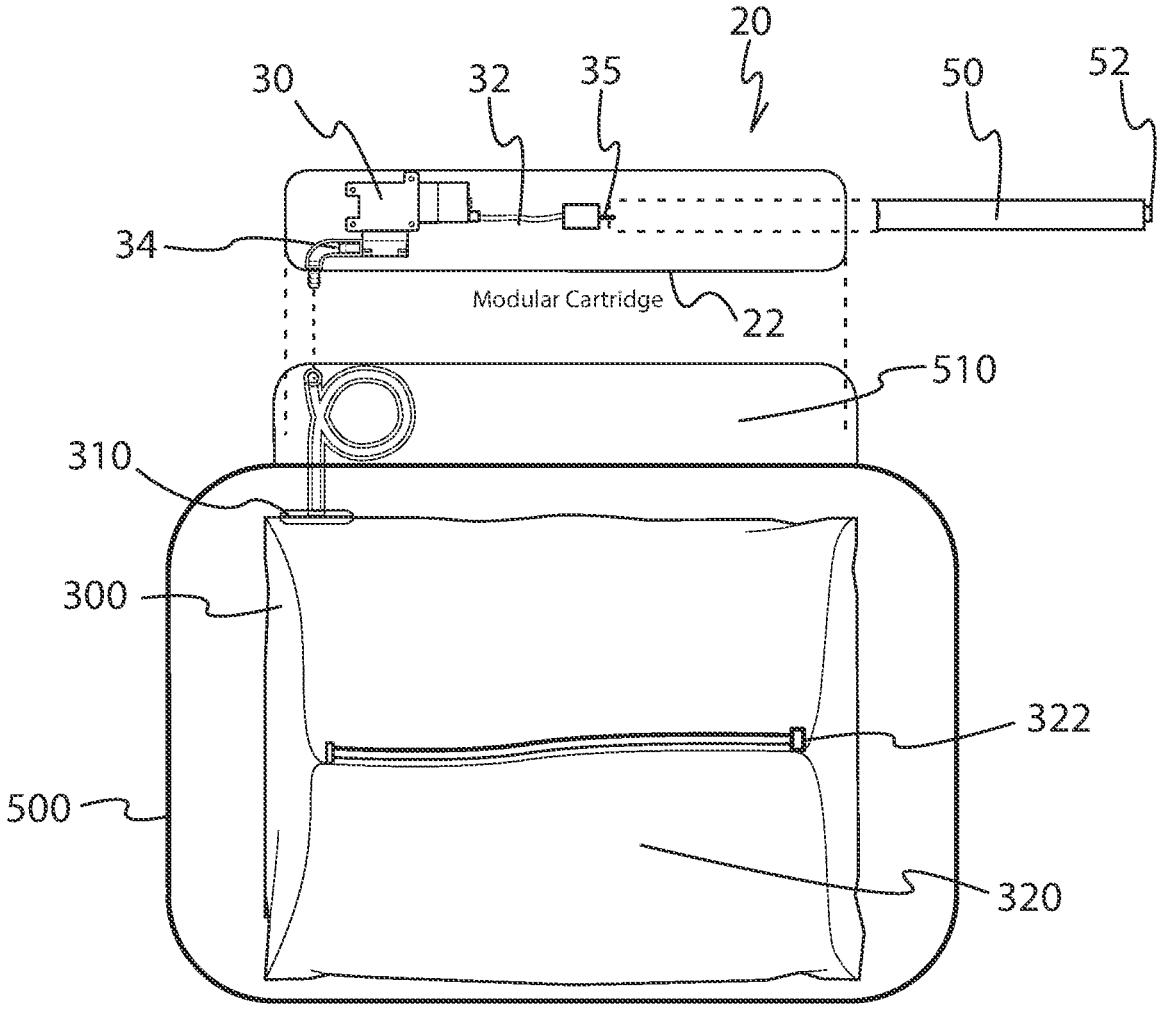
FIG. 1C illustrates a non-limiting embodiment of at least the main components for a self-contained portable vacuum compression system shown in a non-limiting external modular configuration in accordance with the present disclosure.
Figure 2A:
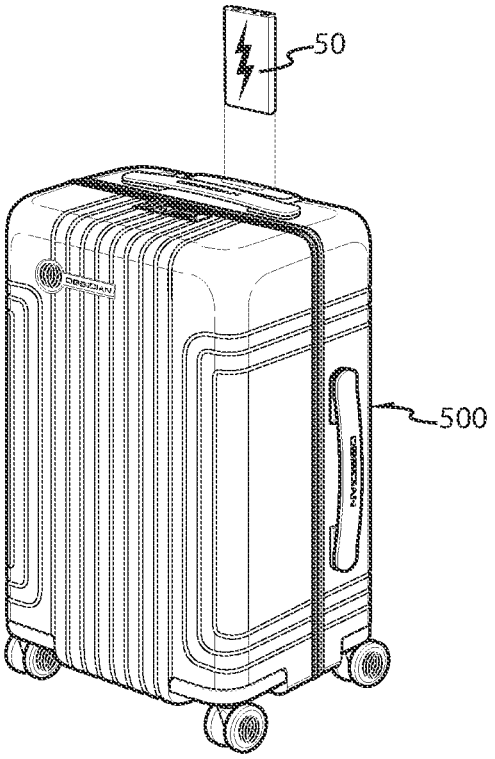
FIG. 2A is a perspective view of a representative sample for a soft shell or hard shell luggage having a retractable handle and two or more wheels on its bottom and with a self-contained internal compression system preferably mounted within the interior base of the luggage in accordance with one embodiment of the present disclosure.
Figure 2B:
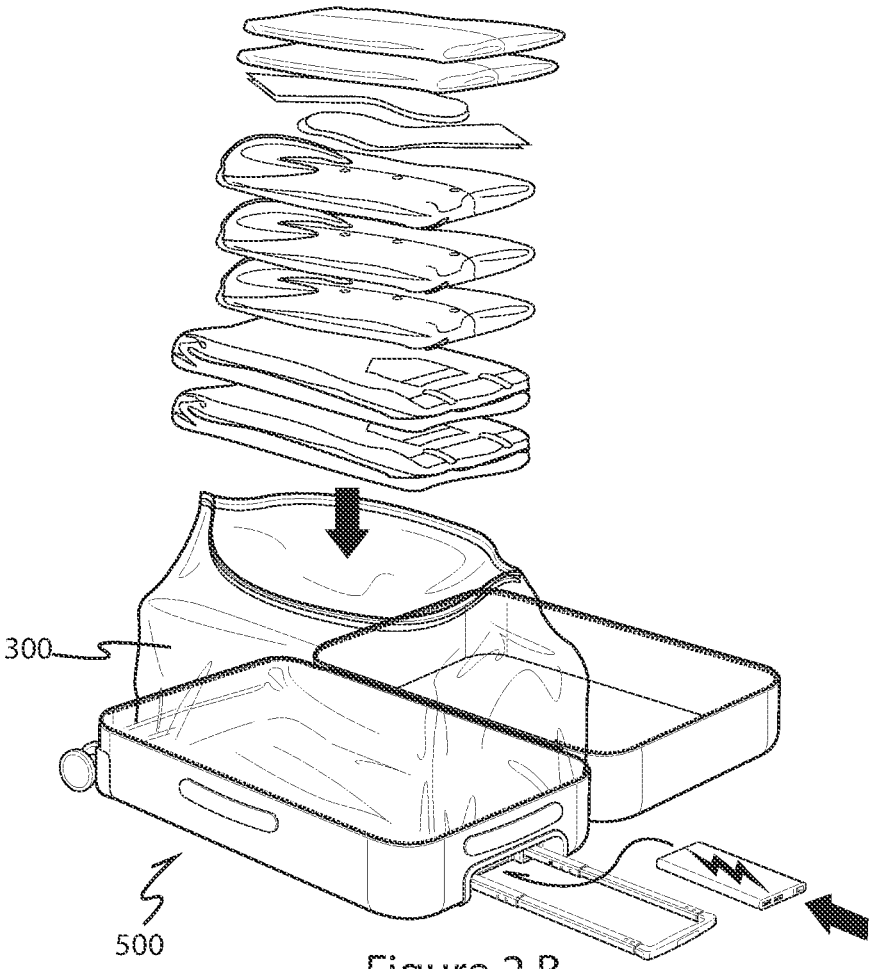
FIG. 2B is a perspective view of the luggage of FIG. 2A in an opened position and showing a vacuum bag opened and about to receive a plurality of clothing.
Figure 2C:
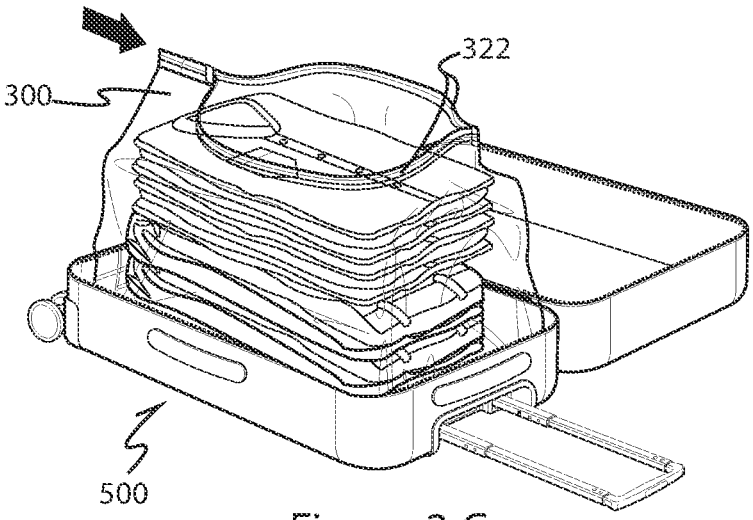
FIG. 2C is a perspective view of the clothing received and packed within the vacuum bag of FIG. 2B and protruding outward of the opened luggage prior to compression using the novel internal compression system.
Figure 3A:
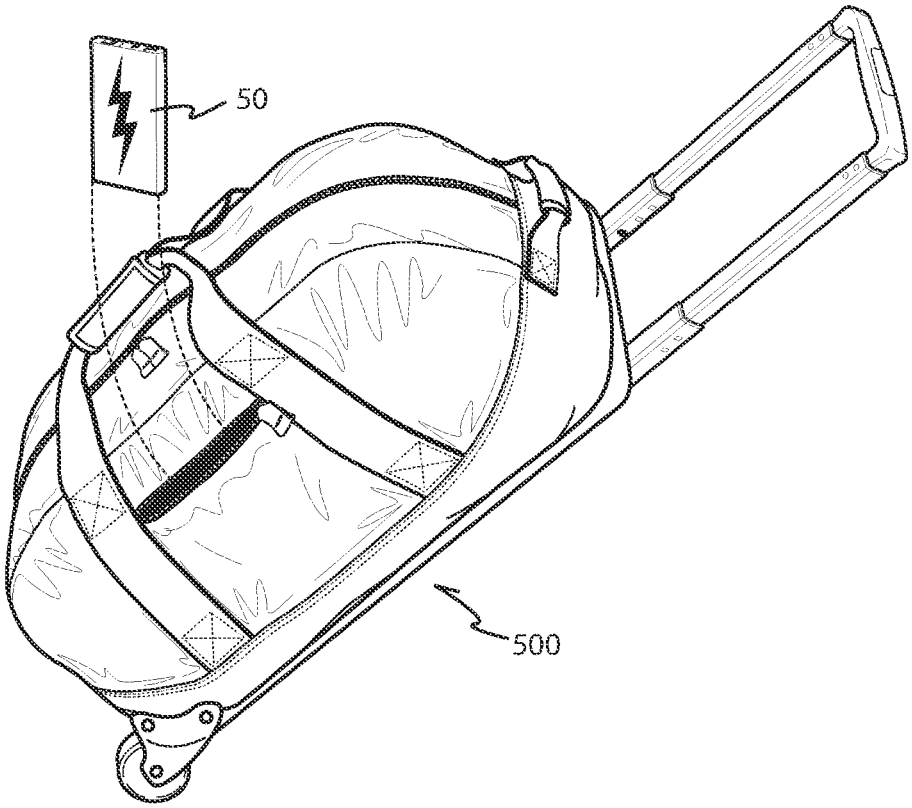
FIG. 3A is a perspective view of a representative sample for a wheeled duffle bag (i.e. two or more wheels) and having a retractable handle and with a self-contained internal compression system preferably mounted within the interior of the wheeled duffle bag or a self-contained external compression system in accordance with one embodiment of the present disclosure.
Figure 3B:
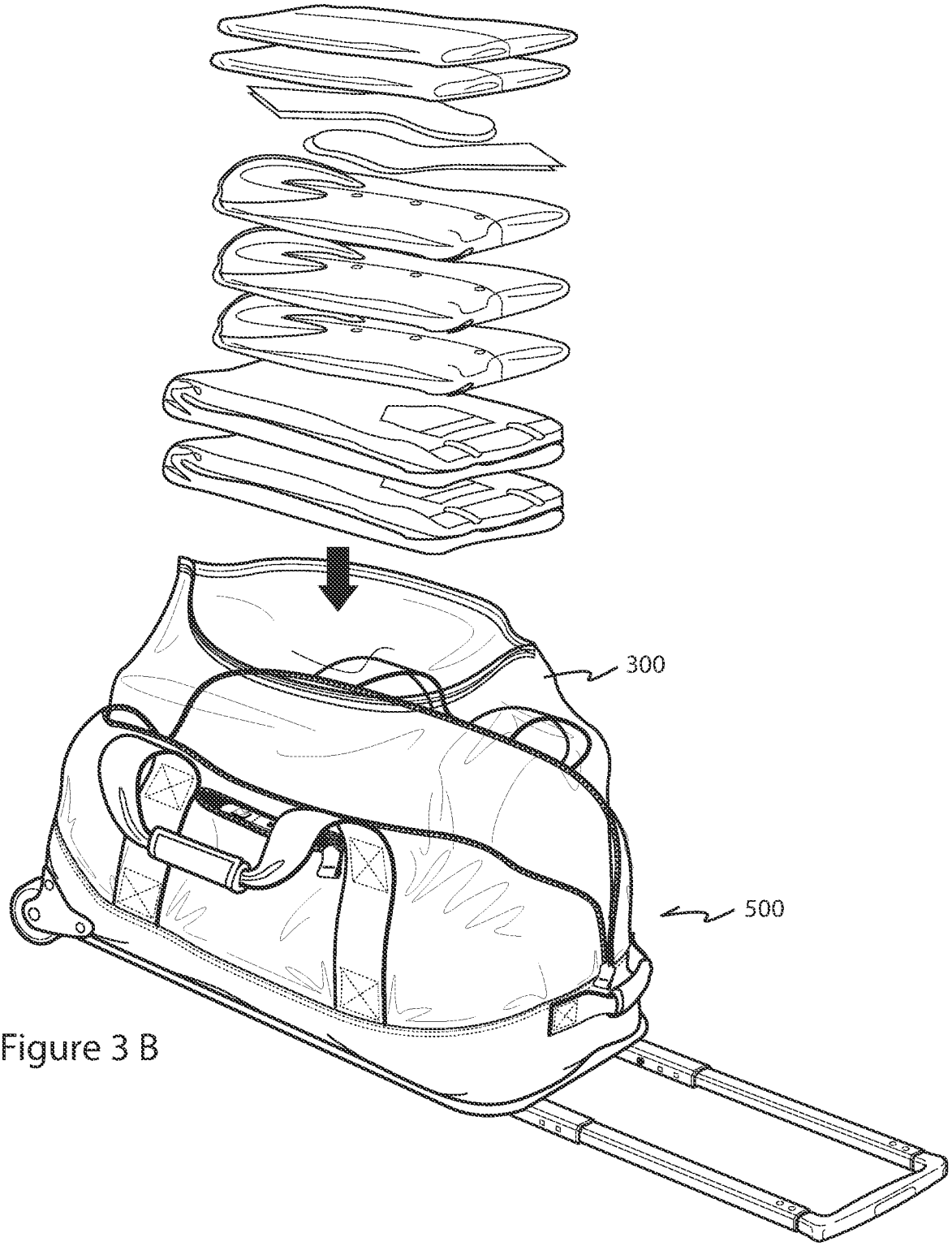
FIG. 3B is a perspective view of the duffle bag of FIG. 3A in an opened position and showing a vacuum bag opened and about to receive a plurality of clothing.
Figure 3C:
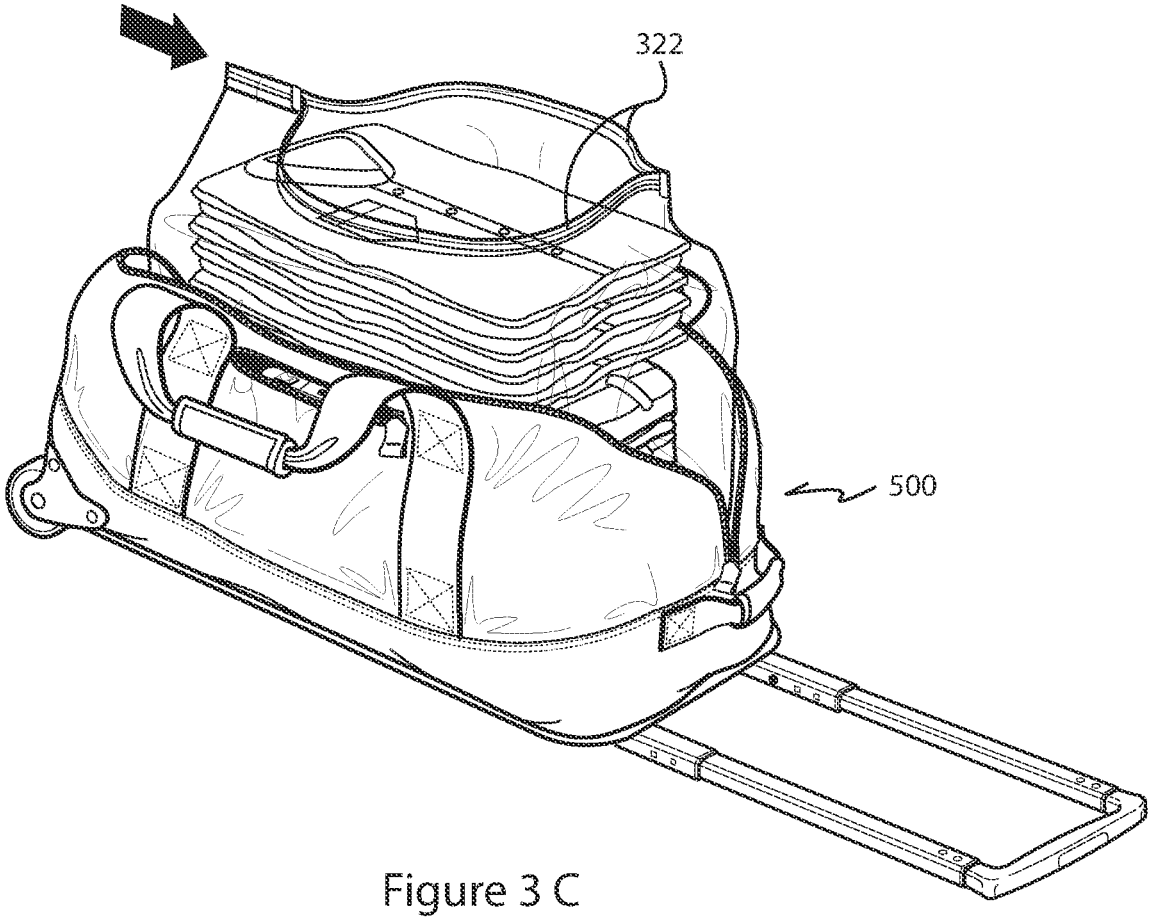
FIG. 3C is a perspective view of the clothing received and packed within the vacuum bag of FIG. 3B and protruding outward of the opened duffle bag prior to compression using the novel internal or external compression system.
Figure 3D:
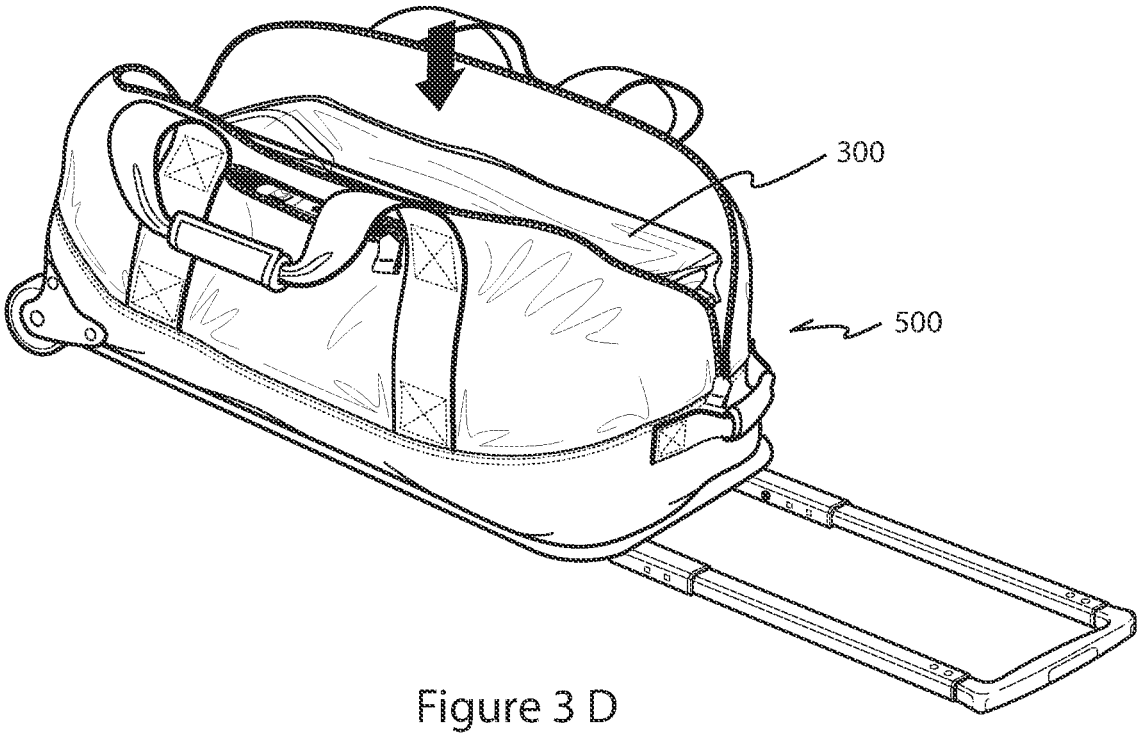
FIG. 3D is a perspective view of the vacuum bag and packed clothing having a reduced size and fitting within the dimensions of the duffle bag after use of the internal or external compression system in accordance with the present disclosure.
Figure 4A:
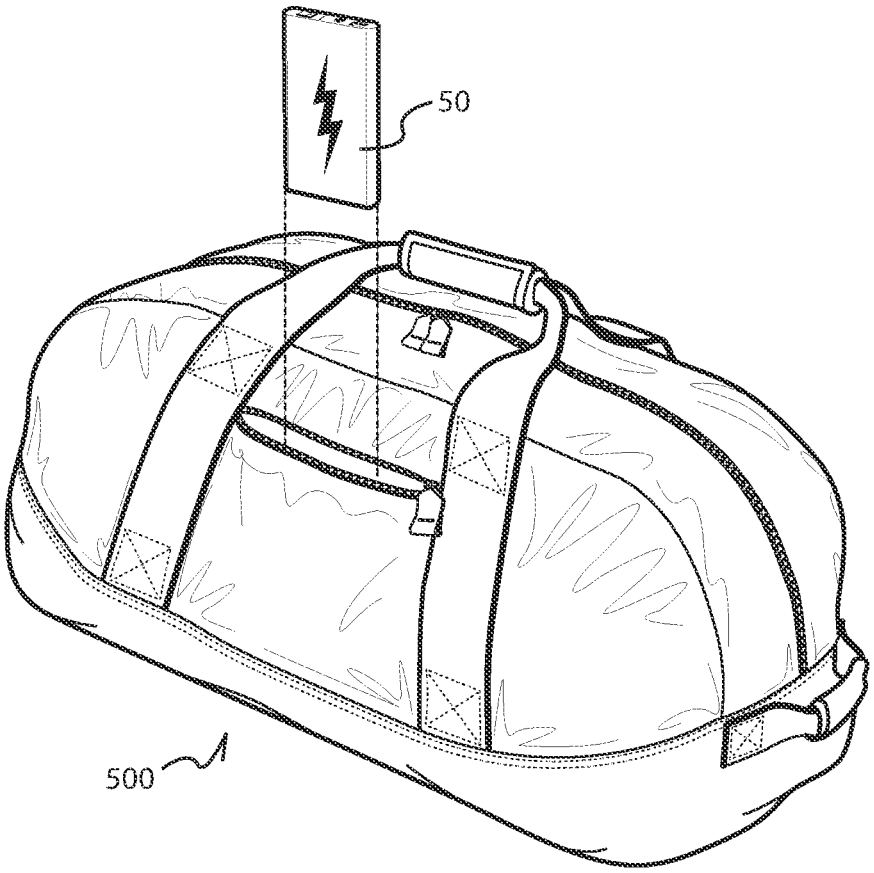
FIG. 4A is a perspective view of a representative sample for a hand-carried duffle bag/gym bag and with a self-contained internal compression system preferably mounted within the interior of the duffle bag/gym bag or a self-contained external compression system in accordance with one embodiment of the present disclosure.
Figure 4B:
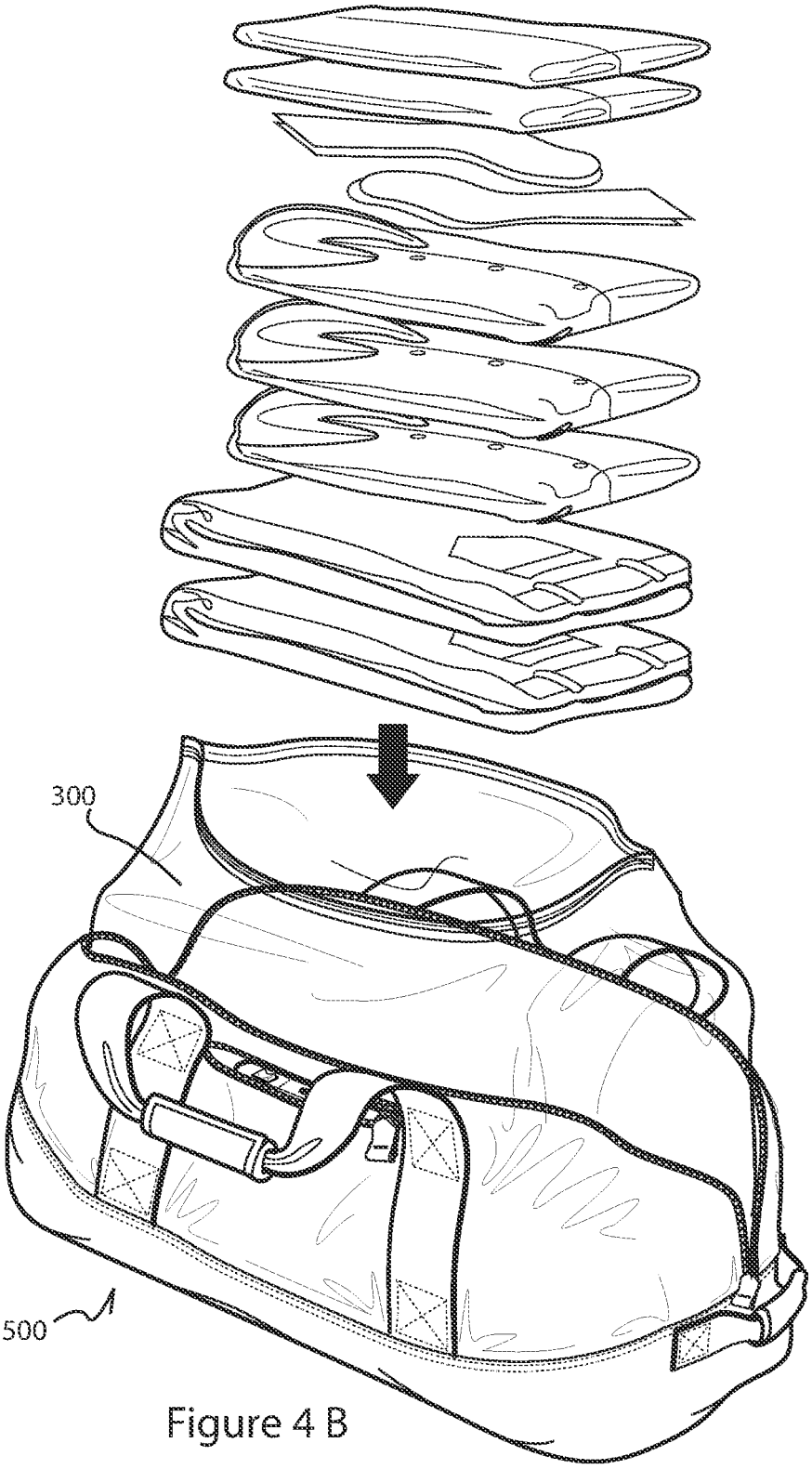
FIG. 4B is a perspective view of the duffle bag/gym bag of FIG. 4A in an opened position and showing a vacuum bag opened and about to receive a plurality of clothing.
Figure 4C:
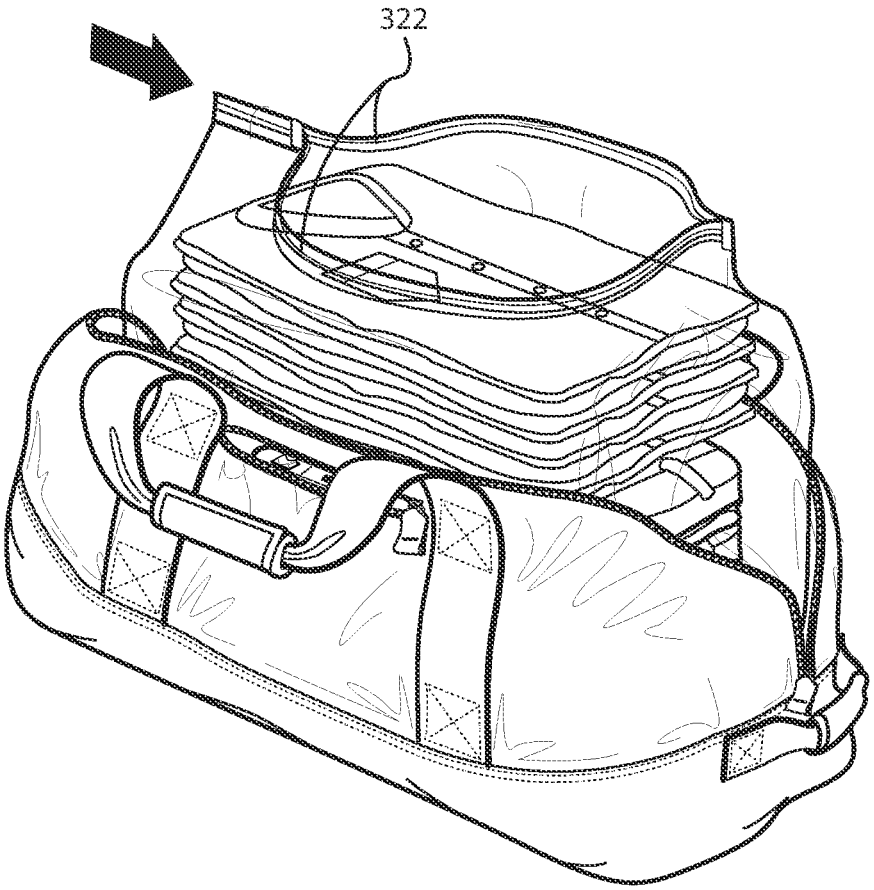
FIG. 4C is a perspective view of the clothing received and packed within the vacuum bag of FIG. 4B and protruding outward of the opened duffle bag/gym bag prior to compression using the novel internal or external compression system.
Figure 4D:
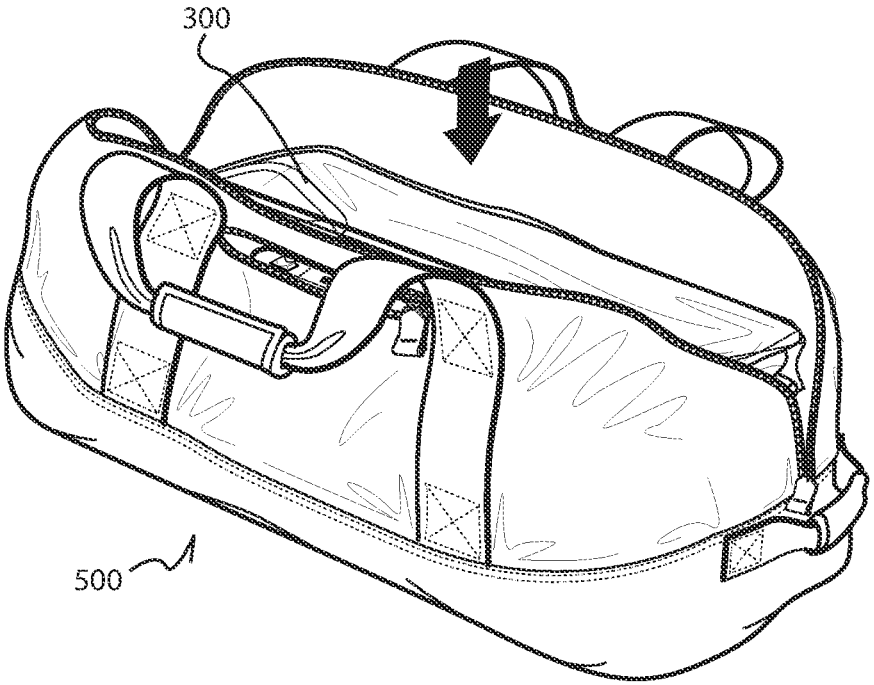
FIG. 4D is a perspective view of the vacuum bag and packed clothing having a reduced size and fitting within the dimensions of the duffle bag/gym bag after use of the internal or external compression system in accordance with the present disclosure.
Figure 5A:
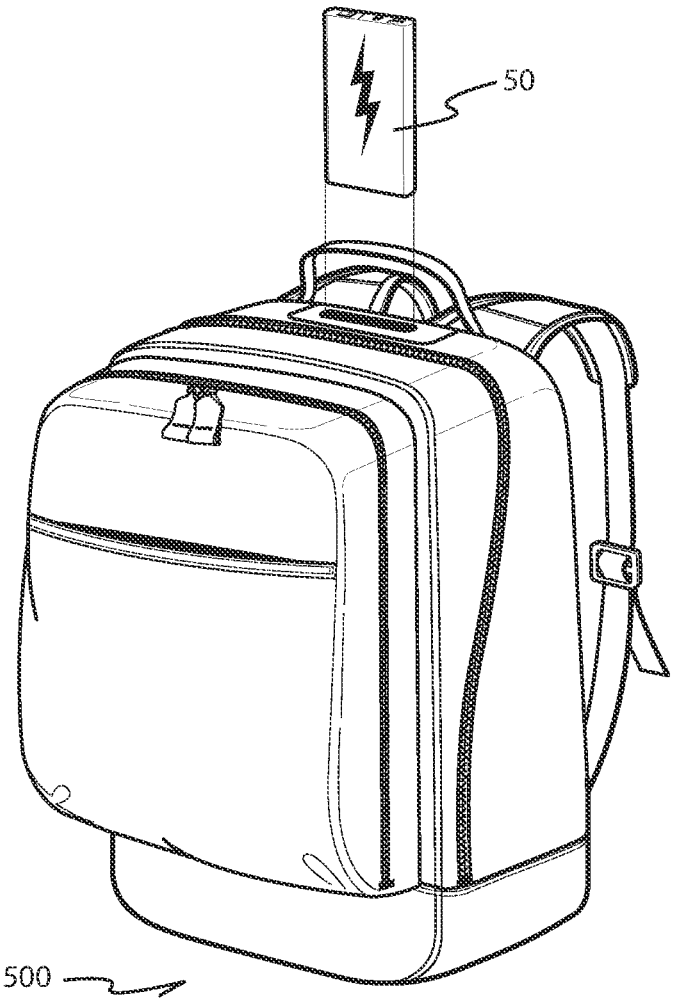
FIG. 5A is a perspective view of a representative sample for a back pack having carrying straps and with a self-contained internal compression system preferably mounted within the interior of the backpack such as, without limitation, against the carrying straps portion/interior wall or other interior wall of the back pack in accordance with one embodiment of the present disclosure.
Figure 5B:
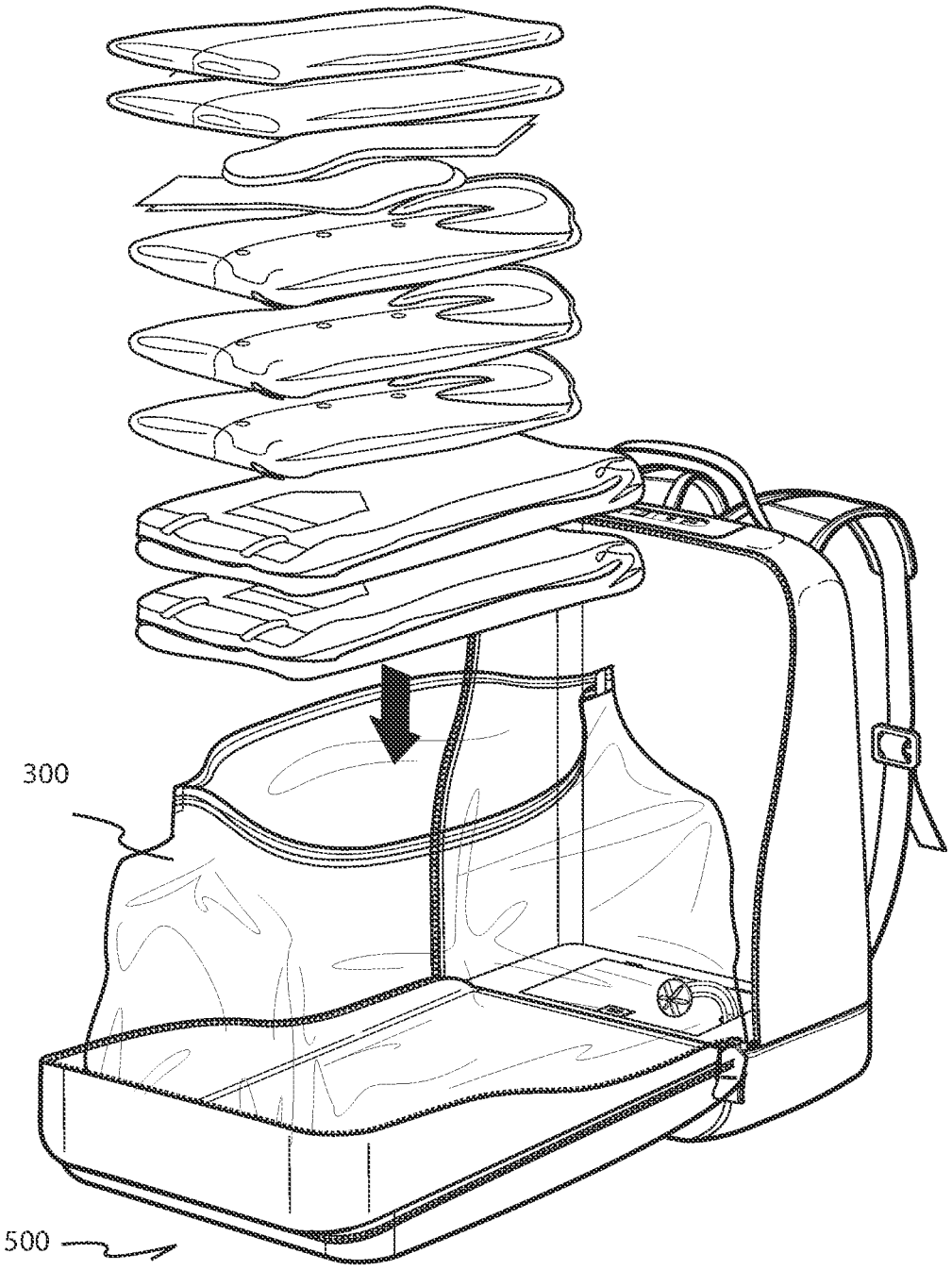
FIG. 5B is a perspective view of the back pack of FIG. 5A in an opened position and showing a vacuum bag opened and about to receive a plurality of clothing.
Figure 5C:
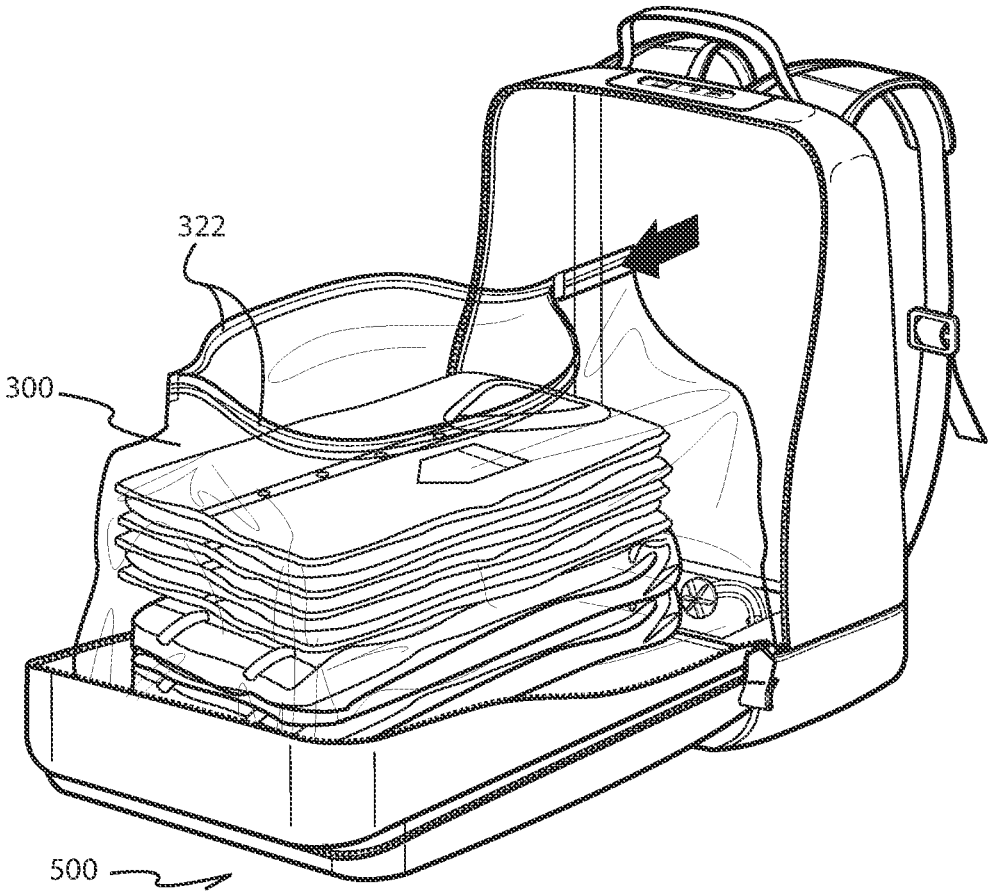
FIG. 5C is a perspective view of the clothing received and packed within the vacuum bag of FIG. 5B and protruding outward of the opened duffle back pack prior to compression using the novel internal compression system.
Figure 5D:
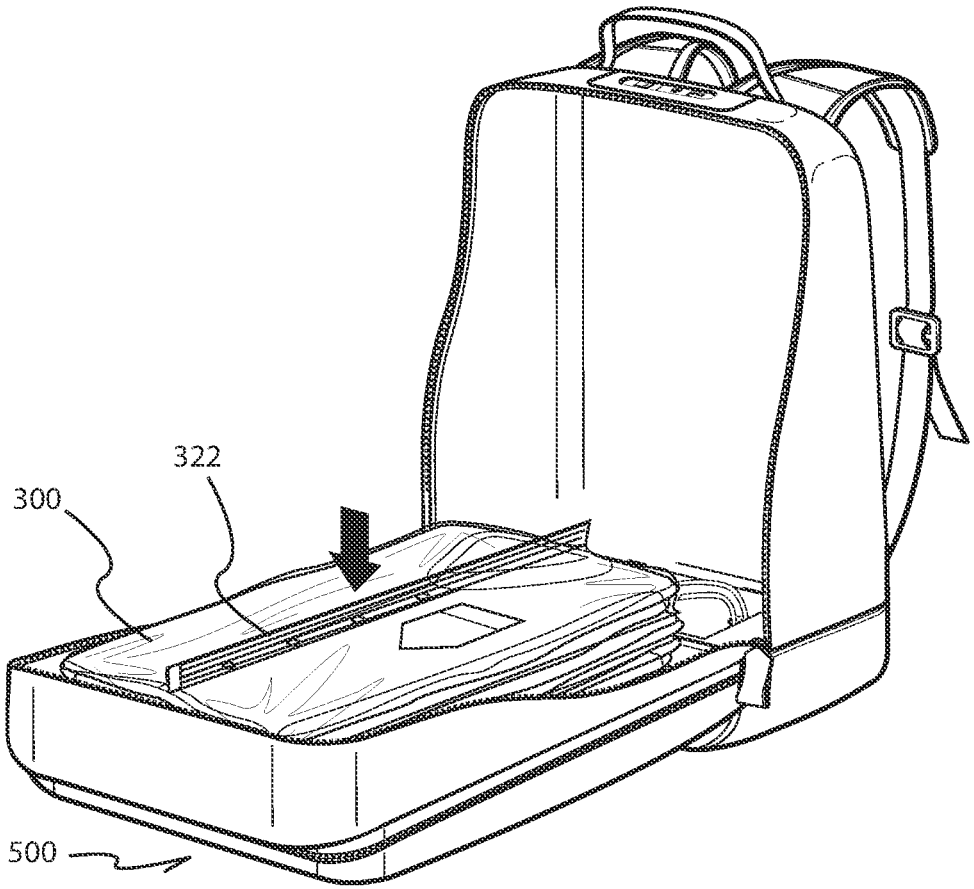
FIG. 5D is a perspective view of the vacuum bag and packed clothing having a reduced size and fitting within the dimensions of the back pack after use of the internal compression system in accordance with the present disclosure.
Figure 7A:
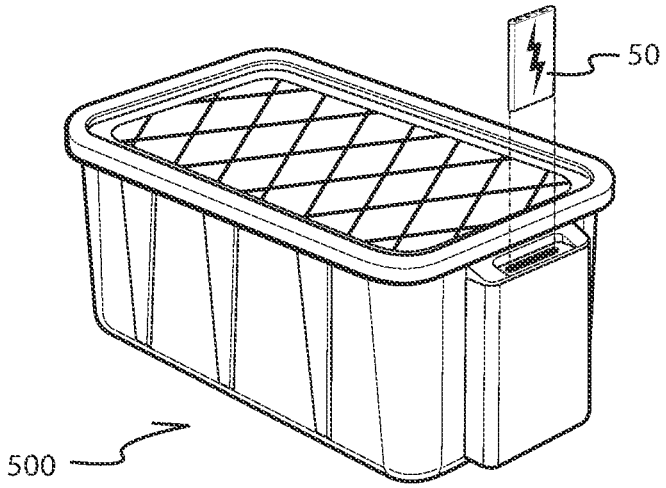
FIG. 7A is a perspective view of a representative sample for a container having a self-contained internal, external or modular compression system which can be preferably mounted or disposed externally or internally within the container or within an outer compartment for the container in accordance with one embodiment of the present disclosure.
Figure 8A:
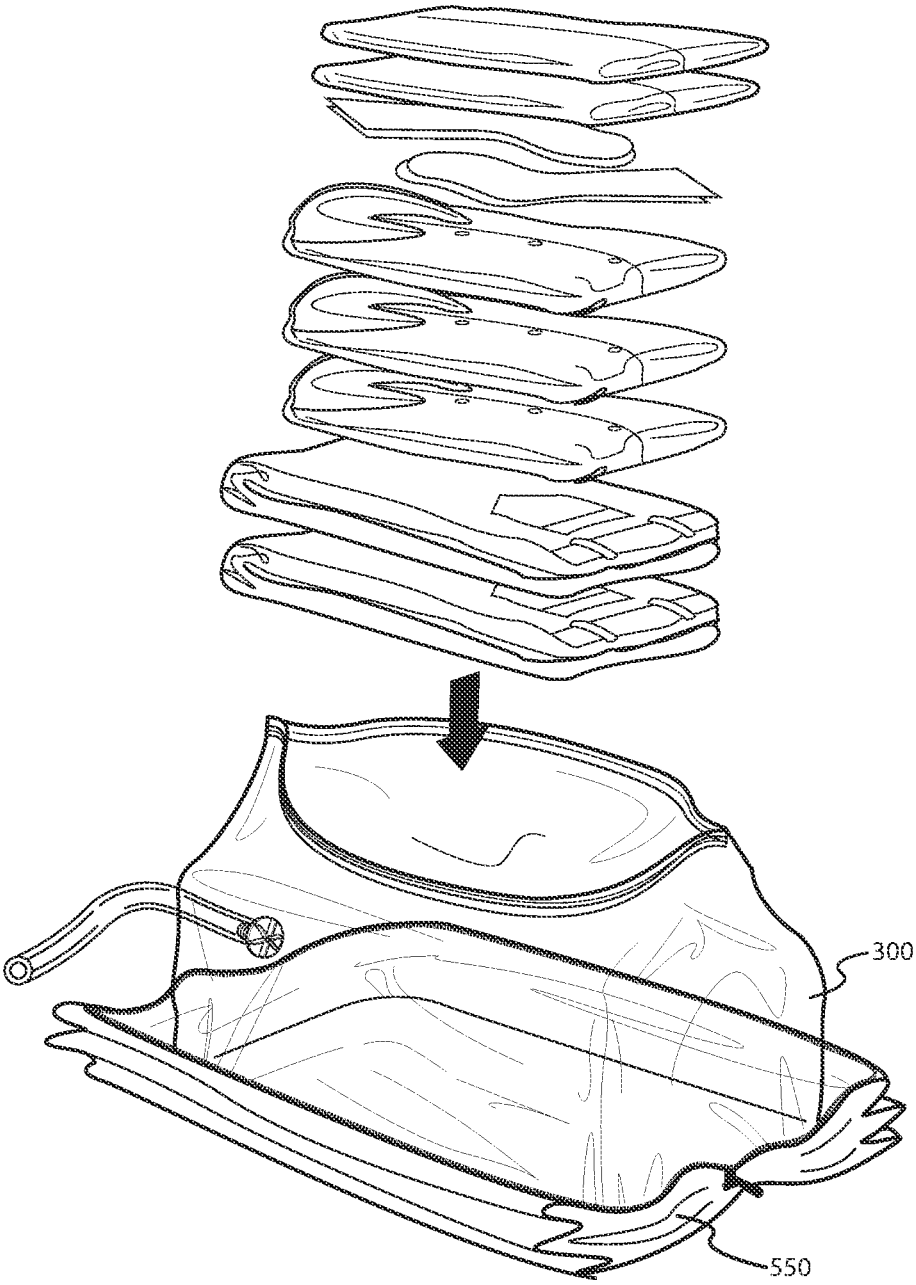
FIG. 8A is a perspective view of a representative sample for an insert sleeve for use with a modular compression system which can be preferably mounted or disposed externally with respect to the insert sleeve in accordance with one embodiment of the present disclosure and with the insert sleeve in an opened position and showing a vacuum bag opened and about to receive a plurality of clothing.
Figure 8B:
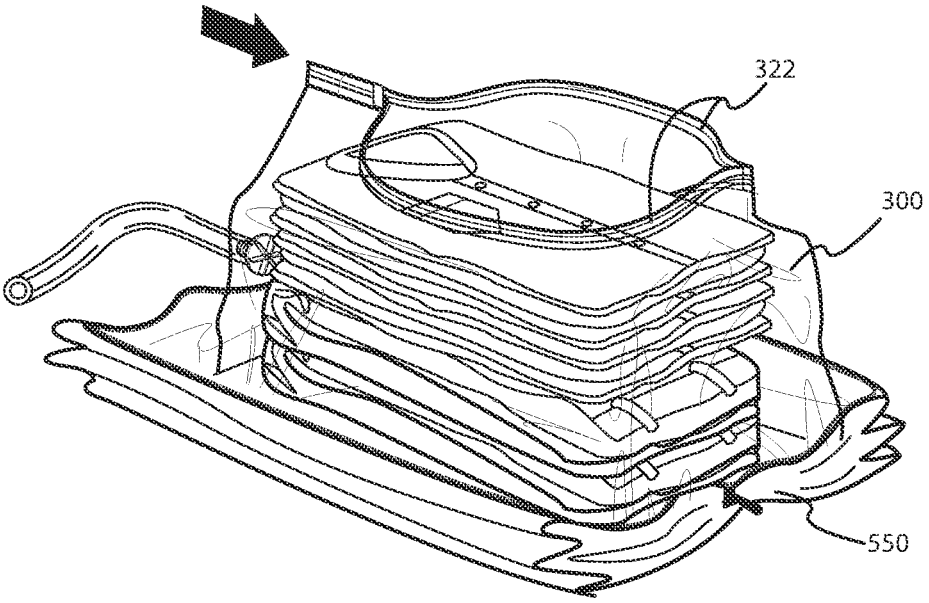
FIG. 8B is a perspective view of the clothing received and packed within the vacuum bag of FIG. 8A and protruding outward of the opened insert sleeve prior to compression using the novel modular compression system.
Figure 8C:
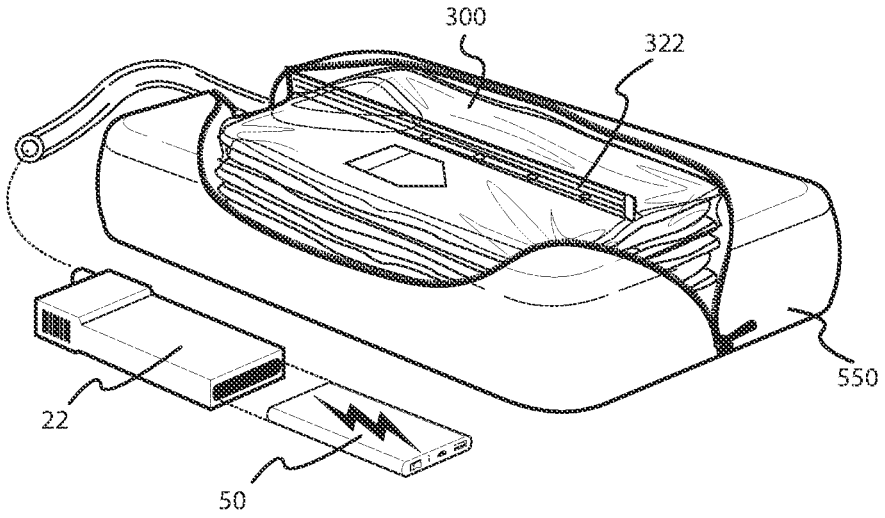
FIG. 8C is a perspective view of the vacuum bag and packed clothing having a reduced size and fitting within the dimensions of the insert sleeve after use of the modular compression system in accordance with the present disclosure.
Figure 8D:
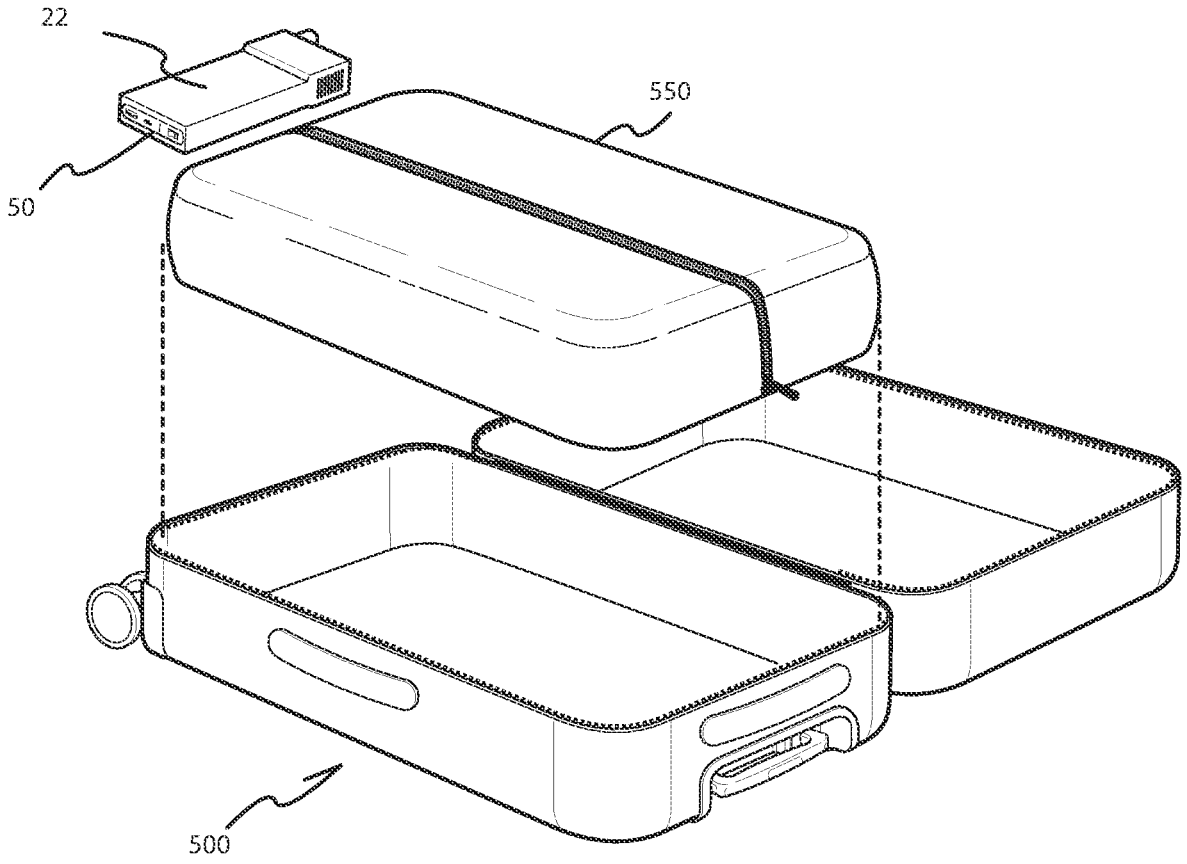
FIG. 8D is a perspective view showing the packed and closed insert sleeve being disposed within a travel bag.
Figure 9A:
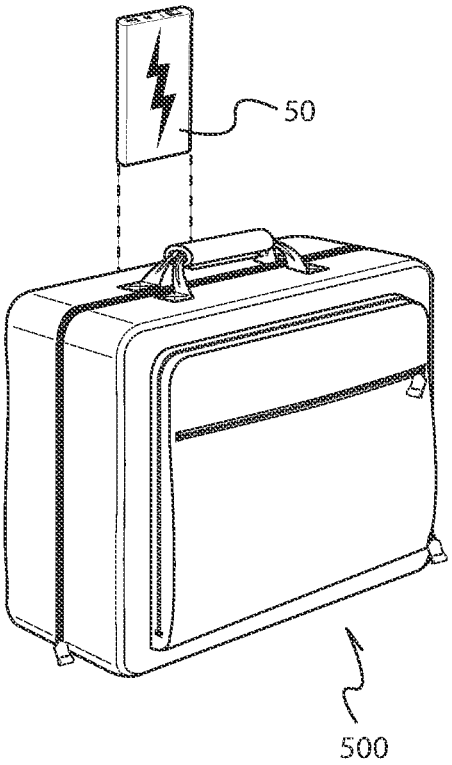
FIG. 9A is a perspective view of a representative sample for a garment bag/foldable garment bag and with a self-contained internal compression system preferably mounted within the interior of the garment bag or a self-contained external or modular compression system in accordance with one embodiment of the present disclosure.
Figure 9B:
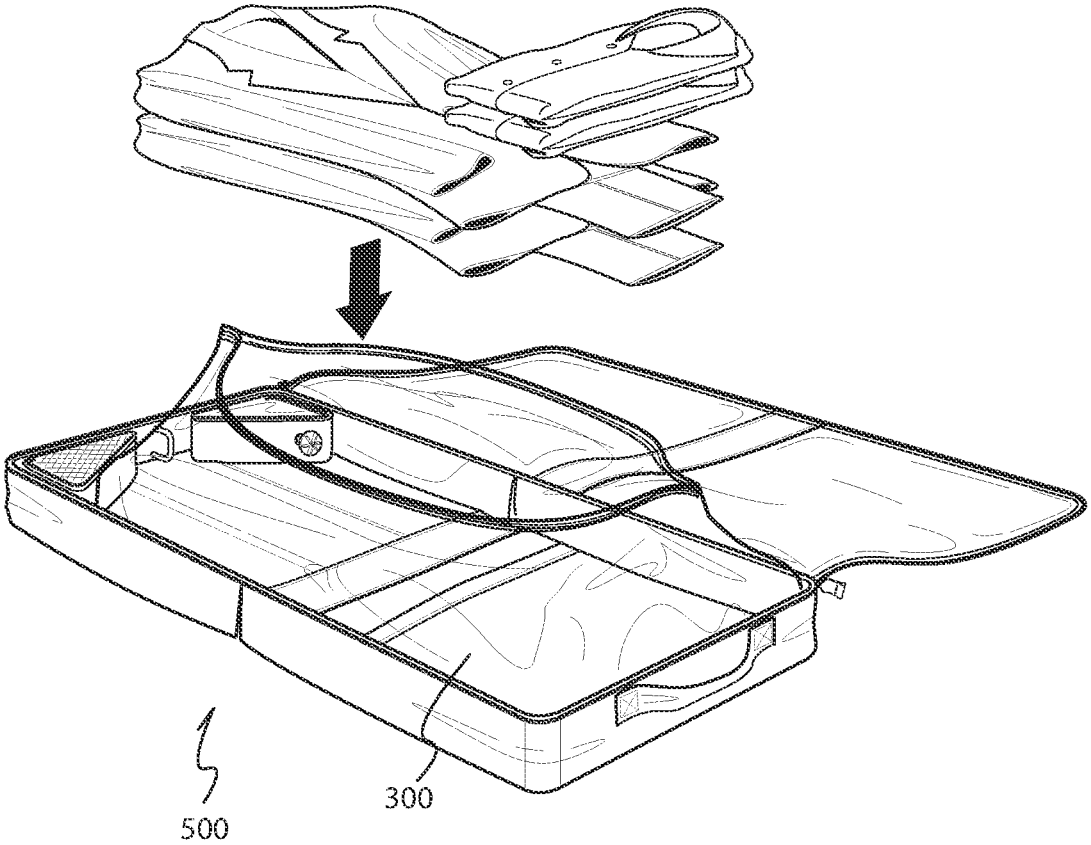
FIG. 9B is a perspective view of the garment bag/foldable garment bag of FIG. 9A in an opened position and showing a vacuum bag opened and about to receive a plurality of clothing.
Figure 9C:
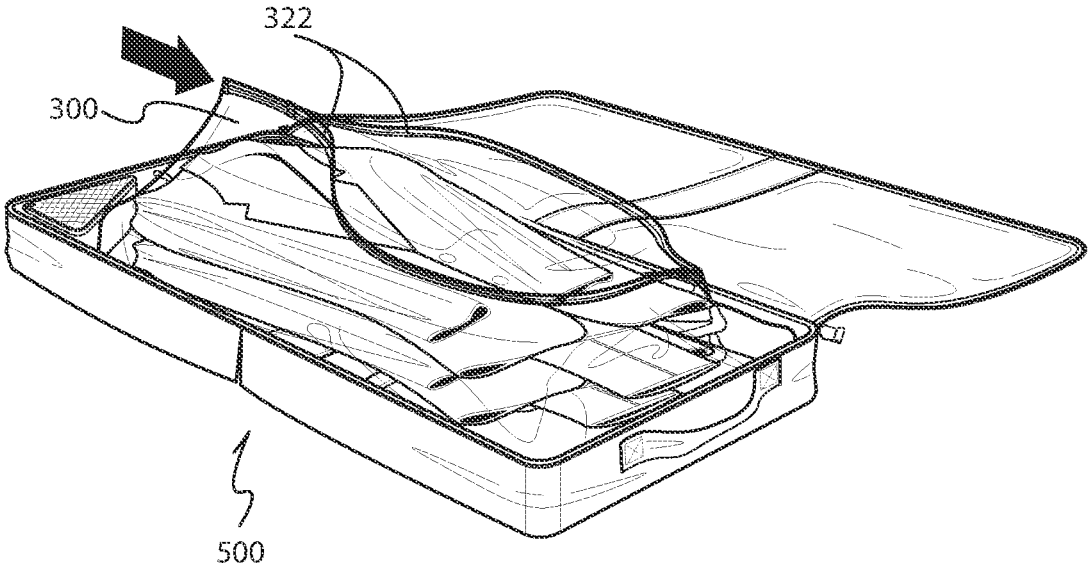
FIG. 9C is a perspective view of the clothing received and packed within the vacuum bag of FIG. 9B and protruding outward of the opened garment bag/foldable garment bag prior to compression using the novel internal, external or modular compression system.
Figure 9D:
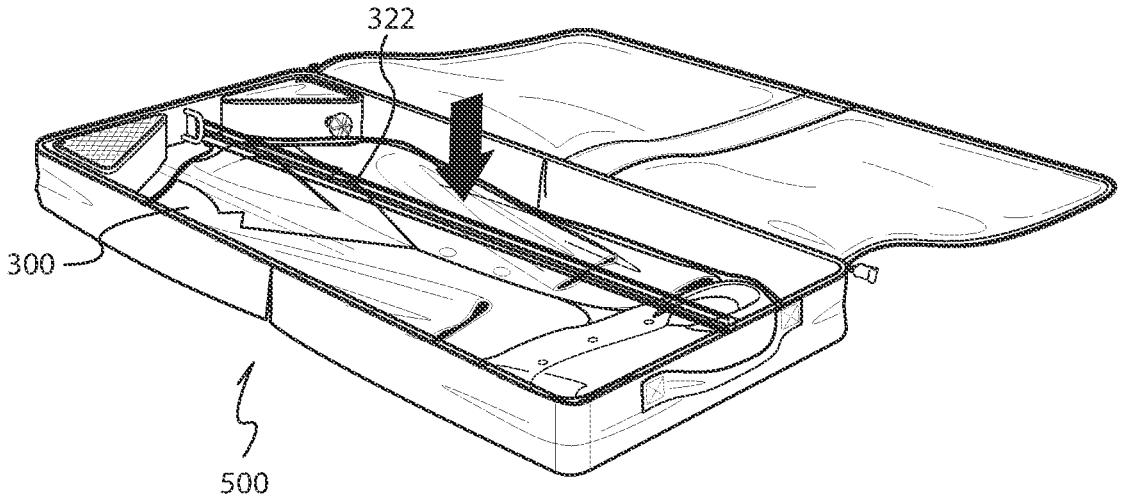
FIG. 9D is a perspective view of the vacuum bag and packed clothing having a reduced size and fitting within the dimensions of the garment bag/foldable garment bag after use of the internal, external or modular compression system in accordance with the present disclosure.

FIG. 1C illustrates the vacuum compression system 20 in a non-limiting external embodiment with respect to travel bag 500 where system 20 is provided as a modular cartridge 22 containing both vacuum pump 30 (i.e. self-contained modular pump) and rechargeable battery 50. Though modular cartridge is preferably used externally, it is also within the scope of the disclosure to use the modular cartridge embodiment as an internal vacuum compression system. Cartridge 22 is preferably received or housed within outer/external component 510 of travel bag 500. Preferably, a USB port can be also provided on cartridge 22 in addition to providing one or more USB charge ports/ports on battery 50. Battery 50 can be preferably removable from cartridge 22. When inserting battery 50 into modular cartridge 22 the connection pins for the electrical cord for pump 30 can be aligned with the outlet/port/pin openings, etc. for battery 50. One way valve 310 can be provided with an extended tubing/conduit section 313 (i.e. preferably flexible, which can be connected at its outer end to an inlet connector 37 for vacuum pump 30 that extends out of modular cartridge 22 when cartridge 22 is disposed within external component 510. Though not limiting, it is preferred that vacuum pump 30 remains within cartridge 22 at all times and that only battery 50 is removable. Similar to the other embodiments, described above, vacuum pump 30 electrically connects to rechargeable battery 50 and the operation of vacuum pump 30 is controlled by switch 52 of rechargeable battery 50. Preferably, an opening or passthrough is provided in the adjacent wall/side of travel bag 500 that borders both the main internal/storage area of travel bag 500 and the internal/storage area within compartment 510 to allow tubing/conduit 313 to pass through in order to connect vacuum pump 30 with compression bag 300. The operation of vacuum compression system 20 remains the same as described for the embodiments of FIG. 1A and/or FIG. 1B which are incorporated by reference in their entireties.

i. Vacuum Description

The vacuum for vacuum compression system 20 can preferably be a portable vacuum pump 30 which can be installed in travel bag 500 and can be designed to attend travel bag 500 to perform its intended vacuum compression functions. Vacuum pump 30 performs the function of evacuating air out of compression/vacuum bag 300 via intake port 34 and exhausting that air via an exhaust port into the atmosphere on the outside of the compression bag. Vacuum pump 30 can be preferably powered by attached rechargeable battery 50 which may be removable from travel bag 500. Vacuum pump 30 can be activated by the user switching on on/off switch 52 preferably provided with battery 50. Vacuum pump preferably ceases its operation when interior sensors no longer detect the flow of air through the vacuum or when the user manually shuts off on/off switch 52. Intake port 34 and/or the exhaust port may have a back check valve to prevent the back flow of air from the outside atmosphere back through the exhaust port or the intake port which could compromise the integrity of the existing low pressure environment with the substantially air tight conditions inside compression bag 300. Vacuum pump 30 may be of sufficient power to evacuate enough air from compression bag 300 to accomplish the desired amount of compression of the clothing or other goods packed in compression bag 300. Depending upon the internal characteristics of travel bag 500, vacuum pump 30 and battery 50 may be mounted on internal structural components of travel bag 500 (such as luggage handle sleeves or similar fixed components for rigid luggage) or fastened to a frame which can be attached to the interior of travel bag 500 (such as snaps sewn into travel bag interiors, insertion of frame ends into sewn holders, or hook and loop fasteners (VELCRO) or similar attachment systems and mechanisms). The manner of placement and attachment of vacuum pump 30 and battery 50 can be dependent upon the characteristics of travel bag 500. Preferably, there can be at least one vacuum pump 30 and one battery 50 per travel bag 500, though such is not considered limiting.

ii. Compression Connection System

The compression connection system can be a separate component which can accomplish several novel functions within vacuum compression system 20. The compression connection system can be fastened to a valve which can be integrated into vacuum/compression bag 300 at an appropriate location relative to the intake valve 34 of vacuum pump 30. The compression connection system can convey air via an airtight tube from compression bag valve 310 to vacuum pump intake valve 34. All connections can be sufficiently airtight to maintain the vacuum compression of compression bag 300 when vacuum pump 30 has evacuated excess air from within vacuum compression bag 300. One or more back check valves can be provided in the compression connection system and may also be a part of vacuum pump 30 or part of intake valve 34, valve 310 at compression bag 300, or a part of compression connection tube between the two ends of the tube. Any of the means of connection of compression bag 300 to vacuum intake port 34 can be preferably able to be reversed to unlock and remove compression bag 300 at the time it needs replacement. In the event of the use of a screw-on means, the bottom of the compression connection system can press evenly upon the flat surface of the vacuum or the outer shell of the vacuum and is of sufficient area to press against the portion of compression bag 300 which is positioned near vacuum intake port 34 and to preferably keep that portion of compression bag 300 in immovable contact with vacuum intake port 34 and further to create an air tight seal between the compression connection system and vacuum intake port 34. The valve end of the compression connection system can be firm and non-compressible and to prevent any clogging or blockage or closure of valve 310 of compression bag 300 or vacuum intake port 34. The connecting end of the compression connection system can be held above the base of the interface valve connection with dividers or fins or other supporting structures which can provide for the free flow of air from all or most open sides of the compression connection system from the interior of compression bag 300 through valve 310 and into vacuum intake port 34. The fastening features of the compression connection system can permit the compression connection system to be fastened by hand and removed by hand from the vacuum at such times that compression bag 300 needs replacement.

iii. Compression Bag

Compression/vacuum bag 300 can be a three-dimensional shape made of flexible plastic or an airtight fabric or a combination thereof, or any other material that will provide for airtight characteristics, which may be clear or transparent or translucent or opaque (though not limiting) and which may be folded or creased and preferably reused for compression purposes multiple times. The internal space of vacuum bag 300 can be accessed, preferably at a front bag area 320, preferably using a zip lock or similar sealing function 322 which may seal the access point of compression bag 300. A sliding lock or hand locking of zip lock portion 322 of compression bag 300 can close and seal compression bag 300. The body of compression bag 300 can be made or constructed of airtight fabric or plastic or a combination thereof which can be custom sized and engineered to fit into the dimensions and internal shape of the specific travel bag 500 that it is being used with. Compression bag 300 may be provided with a folding support system to facilitate the holding of an open compression bag shape for the packing or unpacking of clothing or other goods in compression bag 300. A valve 310 which can be integrated at the appropriate location in compression bag 300 can serve as one connecting point of the compression system. The body of compression bag 300 can permit the evacuation or partial evacuation of air from the inside of/within compression bag 300 by hand folding and manual compression of compression bag 300 with or without the use of vacuum pump 30 (i.e. preferably in connection with the compression connect system). Since the purpose of compression bag 300 is to vacuum compress clothing or other compressible goods to be stored and carried in travel bag 500 and since the amount of compression can vary based upon the characteristics of those goods being compressed, compression bag 300 can accommodate such variations. The size of the empty and open compression bag 300 may be larger than the internal dimensions of the specific associated travel bag 500. When compression bag 300 is open and empty, the compression bag is likely to extend through the openings of travel bag 500 where the user can obtain access to the interior of compression bag 300 and load the clothing or other goods to be compressed into compression bag 300. Compression bag 300 preferably has an opening at its front area 320 and closing zip locked type system 322 or other sealing mechanism which connects and locks the open access to the interior of compression bag 300. When compression bag 300 is locked closed this can preferably create a substantially or virtually airtight environment within compression bag 300. When the vacuum evacuates the air from the inside of locked compression bag 300, the clothing or other goods within compression bag 300 can be compressed and will occupy a smaller space than existed before the vacuum process. The substantially or virtually airtight environment inside compression bag 300 may maintain the compressed dimensions of the compressed clothing or other goods for many hours. In addition to the fixed point of connection of compression bag 300 with vacuum 30, compression bag 300 may be held in place within travel bag 500 by a removable or adjustable method of fixation within the travel bag. At the time that the user wishes to open and unpack compression bag 300 the opening of zip locked portion 322 of compression bag 300 will release the vacuum and the clothing or other goods may be removed through the top opening in the front area 320 of compression bag 300. Compression bag 300 may be reusable for numerous compression events and may have the characteristics to permit the folding or shaping of compression bag 300 by the user to accomplish the packing of travel bag 500 in a manner desired by the user. There may be additional support or folding or joined scissor type structures provided to facilitate the open shape of compression bag 300. Compression bag 300 can be preferably removable from the integrated vacuum system 20 including detachment from vacuum pump 30 via the unfastening or unscrewing (or otherwise detaching/disconnecting) of the compression connection system when compression bag 300 needs replacement.

FIGS. 2A, 2B, 2C and 2D illustrate use of vacuum compression system 20 with a hard or soft shell luggage type travel bag 500 and preferably using an internal vacuum compression system embodiment.

FIGS. 3A, 3B, 3C and 3D illustrate use of vacuum compression system 20 with a wheeled/retractable handled duffle bag type travel bag 500 and preferably using either an internal or external vacuum compression system embodiment.

FIGS. 4A, 4B, 4C and 4D illustrate use of vacuum compression system 20 with a hand carried duffle bag/gym bag type travel bag 500 and preferably using either an internal or external vacuum compression system embodiment.

FIGS. 5A, 5B, 5C and 5D illustrate use of vacuum compression system 20 with a back pack type travel bag 500 and preferably using an internal vacuum compression system embodiment.

FIGS. 6A, 6B, 6C and 6D illustrate use of vacuum compression system 20 with a carry bag or tote bag type travel bag 500 and preferably using an external or modular vacuum compression system embodiment.

FIGS. 7A, 7B, 7C and 7D illustrate use of vacuum compression system 20 with a container type travel bag 500 and preferably using an internal, external or modular vacuum compression system embodiment. Additionally, though not shown, the container can also have at least two wheels and/or a retractable handle.

FIGS. 8A, 8B, 8C and 8D illustrate use of vacuum compression system 20 with an insert sleeve 550 for use with a travel bag 500 and preferably using a modular vacuum compression system embodiment.

FIGS. 9A, 9B, 9C and 9D illustrate use of vacuum compression system 20 with a foldable garment bag type travel bag 500 and preferably using either an internal or external vacuum compression system embodiment.

The examples in FIGS. 2 though 9 also illustrate removable battery 50 and modular cartridge 22 in certain of the figures. Furthermore, though certain types of compression systems (i.e. internal, external, modular, etc.) may be preferred and specifically described herein for being used with a particular type of travel bag, it is within the scope of the disclosure that any of the types of compression systems can be used for compressing the vacuum bag and contents disposed with any of the travel bags Certain non-limiting advantages, benefits, features and/or functions of the disclosed novel vacuum compression systems comprise:

1. A portable and integrated and reusable vacuum compression system with rechargeable removable battery for use with a travel bag. In this embodiment, a removable vacuum pump assembly can be disposed within the interior space of the travel bag and a rechargeable battery can be attached to the vacuum pump assembly to power the vacuum. The rechargeable battery can also be disposed within the interior space of the travel bag and can be in electrical communication with the vacuum pump assembly to provide power for the vacuum pump assembly.

The compression/vacuum bag can be secured within the interior space of the travel bag. The compression bag can have a first closeable opening wherein clothes and other items can be inserted within the compression bag and a second opening where the compression bag is connected to the removable pump assembly for withdrawing air out of the closed/sealed-virtually sealed compression bag through the second opening and into the vacuum pump assembly through it intake port.

The compression connection system can preferably hold the compression bag onto the vacuum pump assembly in a manner that also secures the positioning of the compression bag. The compression connection system can provide for an airtight connection between the compression bag and the vacuum pump assembly and can permit the free flow of air from the interior of the compression bag through the input/intake port of the vacuum pump assembly.

In operation, with the first opening of the compression bag closed, air can be evacuated out of the air compression bag through the second opening by the removable vacuum pump assembly.

2. The pump assembly can also be located within a portion of the travel bag. In certain embodiments the intake port of the vacuum pump assembly can protrude into the interior of the vacuum compression bag and can be mated with a compression connection system wherein air can be withdrawn from the compression bag by the removable pump assembly. The withdrawn air can be exhausted out of the pump assembly into the interior space of the travel bag shell. It is also within the scope of the disclosure to have the intake port of the vacuum pump disposed within the compression bag in a sealed connection between the intake port and compression bag, such that, the compression connection system may be eliminated and air is withdrawn from within the closed compression bag directly into the intake port and associated vacuum pump.

The vacuum can be provided with an exhaust port to exhaust air evacuated from the compression bag into the atmosphere outside of the compression bag. The vacuum can be provided with at least one back check valve to prevent the back flow of evacuated air back into the compression bag. The vacuum can be provided with an automatic shut off feature which discontinues pump operation when there is stoppage of the flow of air out of the compression bag. The vacuum can be provided with a user activated on/off switch to initiate or to stop the operation of the vacuum pump assembly. The switch can be provided on the vacuum and/or on the rechargeable battery/battery.

The system can also comprise a micro controller and a sensor in electrical communication with the micro controller. The sensor can be in communication with an internal passageway of the vacuum hose. The internal passageway can be in communication with the intake port and the exhaust port. Based on information received from the sensor, the micro controller can programmed to automatically determine when all or a sufficient amount of air has been withdrawn from the compression bag and in such instance the micro controller can be programmed to automatically send a signal to the pump to automatically turn the pump off. In one non-limiting embodiment, the sensor can be a pressure sensor.

A frame or other holding assembly can be provided to preferably secure the vacuum pump assembly with the rechargeable battery which powers the pump assembly. The frame/holding assembly can be custom designed to fit within the travel bag's interior dimensions. Preferably, the novel vacuum assembly can be removably secured to the travel bag (e.g. hard shell travel bag, etc.) by a plurality of boss/screw connections. Thus, the vacuum assembly can be a self-contained vacuum preferably having an outer box or housing.

3. The rechargeable battery can be located within a portion of the travel bag and can be removable after use. Thus, preferably the power source for the vacuum compression system can be a power pack removably inserted and secured within a power pack receiving cavity located within the interior space of the travel bag in one embodiment. The cavity opening can be located in an upper wall portion for inserting and removing the power pack into and out of the cavity.

4. The compression bag can be preferably located within a portion of the travel bag. In an uncompressed state the compression/vacuum bag can extend beyond the dimensions of the interior of the travel bag. The compression bag can be preferably removably connected to the shell of a travel bag by a plurality of clips or other functional connection methods including, but not limited, hook and loop (VELCRO) fasteners. Each clip of the plurality of clips or similar fastening methods can be located in a corresponding corner of the interior space of the travel bag. In one non-limiting embodiment, the compression bag can be made of flexible plastic or air tight fabric or a combination thereof which also may be clear or transparent or translucent or opaque and which may be folded or creased and reused for compression purposes multiple times.

The compression bag can be custom sized and engineered/designed to fit into the dimensions and internal shape of the travel bag. The body of the compression bag may be attached to one or more flexible or movable structures which may include a scissor lift function where the attached structures are to facilitate the maintenance of the open shape of the compression bag, and which permit the folding or other movements to permit the folding of the compression bag when the air inside the compression bag is being evacuated by the vacuum or by hand compression of the compression bag.

The compression bag can also preferably permit the evacuation or partial evacuation of air from the inside of the compression bag by hand folding and manual compressing of the compression bag with or without the use of the vacuum. In one non-limiting embodiment, the compression bag can be provided with a valve or hole or reinforced hole preferably located in or at the bottom of the compression bag which can be placed over the vacuum intake port and the compression bag can be held in place with an airtight seal against the vacuum by the compression connection system.

One purpose of the compression bag is to vacuum compress clothing or other compressible goods to be stored and carried in the travel bag and since the amount of compression can vary based upon the characteristics of those goods being compressed, the compression bag can be engineered or designed to accommodate those variations. The size of the empty and open compression bag can be several times larger than the internal dimensions of the travel bag, though such ratio is not considered limiting. When the compression bag is open and empty, the compression bag preferably extends through the openings of the travel bag where the user can obtain access to the interior of the compression bag and load the clothing or other goods to be compressed into the compression bag.

The compression bag can be preferably provided with an opening and closing zip locked type system which connects and locks the open sides of the compression bag. Other locking mechanisms that can perform the locking/closing/sealing of the open sides of the compression bag can also be used and are considered within the scope of the disclosure. When the compression bag is locked closed an air tight or substantially/virtually air tight environment can be created within the compression bag.

When the vacuum assembly is employed to evacuate the air from the inside of the locked compression bag, the clothing or other goods within the compression bag will be compressed and will occupy a smaller space than existed before the vacuum process. The substantially/virtually air tight environment inside the compression bag can maintain the compressed dimensions of the compressed clothing or other goods for many hours.

In addition to the fixed point of connection of the compression bag with the vacuum, the compression bag may be held in place within the travel bag by a removable or adjustable method of fixation within the travel bag. At the time that the user wishes to open and unpack the compression bag the opening of the zip locked portion of the compression bag releases the vacuum and the clothing or other goods may be removed through the top opening of the compression bag. The compression bag may be reusable for numerous compression events and may have the characteristics to permit the folding or shaping of the compression bag by the user to accomplish the packing of the travel bag in a manner desired by the user.

The compression bag can be removable from the integrated vacuum system including, in one non-limiting embodiment, detachment from the vacuum via the unscrewing of the compression connection system when the compression bag needs replacement. The valve preferably located in the compression bag can be held above the base of the compression connection system with dividers or fins or similar supporting structures which can be engineered or designed to provide for the free flow of air from the open sides of the compression connection system from the interior of the compression bag into the vacuum intake port.

5. The compression connection system is located within a portion of the travel bag. The compression bag can also be directly or indirectly secured to or in communication with the exhaust port to allow air to be drawn through out of the compression bag through the second opening and through the exhaust port of the vacuum. The compression connection system can fasten to the vacuum via a connecting interface which may, without limitation, be a threaded screw type of connection and which can permit the compression connection system to be hand fastened or hand screwed onto the vacuum intake port with sufficient tightness to maintain air tightness and to hold the compression bag in place on the vacuum.

The compression connection system can be engineered/designed to preferably press evenly upon the flat surface of the vacuum and can be of sufficient area to press against the portion of the compression bag which is positioned over the vacuum intake port in order to keep that portion of the compression bag preferably in immovable contact with the vacuum intake port. In use, an air tight or virtually air tight seal between the compression connection system and the vacuum intake port can be created. The top of the compression connection system can be firm and preferably non-compressible in order to prevent clogging or blockage or closure of the vacuum intake port. The compression connection system can also be installed within the inside of the Travel Bag to connect the compression bag to the vacuum intake port. The preferred screw on features of the compression connection system permit the compression connection system to be unscrewed by hand and removed from the vacuum at such times that the compression bag needs replacement.

The exemplary embodiments described herein should be considered in a descriptive sense only and not for purposes of limitation. Descriptions of features or aspects within each embodiment should typically be considered as available for other similar features or aspects in other embodiments. While one or more embodiments have been described with reference to the Figures, it will be understood by those of ordinary skill in the art that various changes in form and details may be made therein without departing from their spirit and scope.

All components of the described system and their locations, electronics, gas/air and mechanical communication/connection methods between the system components, pumps, power sources, battery types, travel bag types, types of vacuum bags, vacuum bag closure/sealing mechanisms, valves, dimensions, materials, values, charging ports, etc. discussed above or shown in the drawings, if any, are merely by way of example and are not considered limiting and other component(s) and their locations, electronics, gas/air and mechanical communication/connection methods between the system components, pumps, power sources, battery types, travel bag types, types of vacuum bags, vacuum bag closure/sealing mechanisms, valves, dimensions, materials, cases, values, charging ports, etc. can be chosen and used and all are considered within the scope of the disclosure.

Dimensions of certain parts as shown in the drawings may have been modified and/or exaggerated for the purpose of clarity of illustration and are not considered limiting.

Unless feature(s), part(s), component(s), characteristic(s) or function(s) described in the specification or shown in the drawings for a claim element, claim step or claim term specifically appear in the claim with the claim element, claim step or claim term, then the inventor does not considered such feature(s), part(s), component(s), characteristic (s) or function(s) to be included for the claim element, claim step or claim term in the claim for examination purposes and when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

While the novel piece of luggage has been described and disclosed in certain terms and has disclosed certain embodiments or modifications, persons skilled in the art who have acquainted themselves with the disclosure, will appreciate that it is not necessarily limited by such terms, nor to the specific embodiments and modification disclosed herein. Thus, a wide variety of alternatives, suggested by the teachings herein, can be practiced without departing from the spirit of the disclosure, and rights to such alternatives are particularly reserved and considered within the scope of the disclosure.

What is claimed is:

1. A self-contained vacuum compression system internally integrated within a travel bag for use in withdrawing air from a sealed vacuum bag for reducing the size of the vacuum bag when storing the vacuum bag within an interior area of the travel bag, the travel bag having a body that defines a permanent opening, the vacuum compression system comprising:

a vacuum pump assembly having an electrical cord having one or more prongs and an air intake port and positioned internally within the interior area of the travel bag;

a portable rechargeable battery positioned within the interior area of the travel bag such that the portable rechargeable battery is aligned with the permanent opening of the travel bag to allow the portable rechargeable battery to be removed from within the travel bag while the travel bag is in a closed position, the portable rechargeable battery positioned external and independent from the vacuum pump assembly, the portable rechargeable battery having a switch and at least one electrical port or outlet, in use the one or more prongs of the electrical cord of the vacuum pump assembly are positioned within the at least one electrical port or outlet to provide an electrical connection between the portable rechargeable battery and the vacuum pump assembly; wherein the switch in an "on" position allows power from the battery to be delivered to the vacuum pump assembly to cause the vacuum pump assembly to operate;

a sealable vacuum bag having an air outlet port including a one-way valve and having a resealable opening for obtaining access to an interior area of the vacuum bag for storing or removing items from within the interior area of the vacuum bag; and a connection conduit having a first end and a second end, the first end of the connection conduit connected to the air outlet port of the vacuum bag and the second end of the connection conduit connected to the air intake port of the vacuum pump assembly;

wherein in use the vacuum pump assembly secured in position within the interior area of the travel bag.

2. The vacuum compression system of claim 1 wherein when the switch of the rechargeable battery is in an "on" position the vacuum pump assembly is turned on without having to press any other switches.

3. The vacuum compression system of claim 1 wherein the vacuum pump assembly, the rechargeable battery and the connection conduit are located internally within the travel bag when the vacuum pump assembly is on and being used to withdraw air from within the vacuum bag.

4. The vacuum compression system of claim 1 wherein the rechargeable battery is removable from the travel bag when not in use.

5. The vacuum compression system of claim 1 wherein the rechargeable battery having one or more additional ports for use in charging portable electronic devices.

6. The vacuum compression system of claim 5 wherein the one or more additional ports are one or more USB ports.

7. The vacuum compression system of claim 1 further comprising a frame member for securing the vacuum pump assembly in place within the interior area of the travel bag.

8. A vacuum compression system internally integrated within a travel bag for use in withdrawing air from a sealed reusable vacuum bag for reducing the size of the vacuum bag when storing the vacuum bag within an interior area of the travel bag, the travel bag having a body that defines a permanent opening; the vacuum compression system comprising:

a vacuum pump assembly having an electrical wire and an air intake port and positioned internally within an interior area of a travel bag;

a removable rechargeable battery positioned within the interior area of the travel bag such that the portable rechargeable battery is aligned with the permanent opening of the travel bag to allow the portable rechargeable battery to be removed from within the travel bag while the travel bag is in a closed position, the portable rechargeable battery positioned external and independent from the vacuum pump assembly, the rechargeable battery having a switch and at least one electrical port or outlet, in use the electrical wire of the vacuum pump assembly electrically connected to the at least one electrical port or outlet, the rechargeable battery having one or more USB ports for use in charging portable electronic devices;

a single sealable reusable vacuum bag having an air outlet port including a one-way valve; and a connection conduit having a first end and a second end, the first end of the connection conduit connected to the air outlet port of the vacuum bag and the second end of the connection conduit connected to the air intake port of the vacuum pump assembly;

wherein when the switch of the rechargeable battery is in an "on" position the vacuum pump assembly is turned on;

wherein in use the vacuum pump assembly secured in position within the interior area of the travel bag;

wherein the travel bag only housing a single sealable vacuum bag at any time.

9. The vacuum compression system of claim 8 wherein the vacuum pump assembly, the rechargeable battery and the connection conduit are located internally within the travel bag when the vacuum pump assembly is on and being used to withdraw air from within the vacuum bag.

10. The vacuum compression system of claim 8 further comprising the travel bag having the interior area.

11. The vacuum compression system of claim 8 further comprising a frame member for securing the vacuum pump assembly in place within the interior area of the travel bag.

12. A vacuum compression system internally integrated within a travel bag for use in withdrawing air from a sealed vacuum bag for reducing the size of the vacuum bag when storing the vacuum bag within an interior area of the travel bag, the travel bag having a body that defines a permanent opening, the vacuum compression system comprising:

a vacuum pump assembly having an electrical wire and an air intake port and positioned internally within the interior area of the travel bag;

a rechargeable battery positioned within the interior area of the travel bag such that the portable rechargeable battery is aligned with the permanent opening of the travel bag to allow the portable rechargeable battery to be removed from within the travel bag while the travel bag is in a closed position, the portable rechargeable battery positioned external and independent from the vacuum pump assembly, the rechargeable battery having a switch and at least one electrical port or outlet, in use the electrical wire of the vacuum pump assembly electrically connected to the at least one electrical port or outlet, a single sealable vacuum bag having an air outlet port including a one-way valve; and a connection conduit having a first end and a second end, the first end of the connection conduit removably connected to the air outlet port of the vacuum bag and the second end of the connection conduit connected to the air intake port of the vacuum pump assembly;

wherein in use the vacuum pump assembly secured in position within the interior area of the travel bag;

wherein the travel bag only housing a single sealable vacuum bag at any time.

13. The vacuum compression system of claim 1 further comprising the travel bag having the interior area.

14. The vacuum compression system of claim 12 further comprising the travel bag having the interior area.

15. The vacuum compression system of claim 12 further comprising a frame member for securing the vacuum pump assembly in place within the interior area of the travel bag.

* * * * *